US009670703B2

(12) United States Patent
Hanaki et al.

(10) Patent No.: US 9,670,703 B2
(45) Date of Patent: Jun. 6, 2017

(54) OPENING-AND-CLOSING DEVICE FOR VEHICLE DOOR

(71) Applicant: MITSUI KINZOKU ACT CORPORATION, Kanagawa (JP)

(72) Inventors: Naoki Hanaki, Kanagawa (JP); Kohei Yamashita, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 108 days.

(21) Appl. No.: 14/691,171

(22) Filed: Apr. 20, 2015

(65) Prior Publication Data

US 2016/0010364 A1 Jan. 14, 2016

(30) Foreign Application Priority Data

Jul. 10, 2014 (JP) ..... 2014-142223

(51) Int. Cl.

| | |
|---|---|
| ***E05B 65/10*** | (2006.01) |
| ***E05B 83/40*** | (2014.01) |
| ***E05B 81/20*** | (2014.01) |
| *E05B 81/16* | (2014.01) |
| *E05B 79/20* | (2014.01) |
| *E05B 81/06* | (2014.01) |

(52) U.S. Cl.

CPC ..... *E05B 83/40* (2013.01); *E05B 81/20* (2013.01); *E05B 79/20* (2013.01); *E05B 81/06* (2013.01); *E05B 81/16* (2013.01)

(58) Field of Classification Search

CPC ..... Y10T 292/1082; Y10T 292/0978; Y10T 292/699; E05B 81/20; E05B 83/36; E05B 77/30; Y10S 292/23

USPC ..... 292/21, 216, 201, DIG. 23, DIG. 65, 92

See application file for complete search history.

(56) References Cited

U.S. PATENT DOCUMENTS

| | | | | |
|---|---|---|---|---|
| 5,534,846 A * | 7/1996 | Kuroda | ..... | E05B 77/48 180/287 |
| 5,893,593 A * | 4/1999 | Dowling | ..... | E05B 77/26 292/169.11 |
| 6,048,002 A * | 4/2000 | Ohta | ..... | E05B 81/20 292/201 |

(Continued)

FOREIGN PATENT DOCUMENTS

| | | |
|---|---|---|
| JP | 2005-213818 A | 8/2005 |
| JP | 4428047 B2 | 3/2010 |

*Primary Examiner* — Mark Williams

(74) *Attorney, Agent, or Firm* — McDermott Will & Emery LLP

(57) ABSTRACT

An opening-and-closing device for vehicle door includes: a close-latch mechanism; an electric-powered releasing mechanism; an association mechanism; a relay mechanism; an electric open/close unit; and a control unit. The relay mechanism switches from a connection state to a disconnection state by the operation of an association mechanism in a cancellation direction to allow returning a first ratchet stopped at a release position. The control unit reversely controls the electric open/close unit, operates a door to be opened toward a fully opened position, operate the association mechanism in a cancellation direction, and switches the relay mechanism to the disconnection state, upon detection of operational malfunction of the electric-powered releasing mechanism during closing of the door from the fully opened position to a fully closed position by closing operation of the electric open/close unit.

1 Claim, 17 Drawing Sheets

(56) References Cited

U.S. PATENT DOCUMENTS

| | | | | |
|---|---|---|---|---|
| 6,116,664 | A * | 9/2000 | Wegner | E05B 81/66<br>292/201 |
| 6,223,468 | B1 * | 5/2001 | Kobayashi | E05B 81/20<br>292/201 |
| 8,333,414 | B2 * | 12/2012 | Takayanagi | E05B 81/14<br>292/201 |
| 2003/0067175 | A1 * | 4/2003 | Shiota | E05B 81/20<br>292/201 |
| 2005/0167991 | A1 * | 8/2005 | Yoneyama | E05B 81/20<br>292/201 |
| 2006/0202485 | A1 * | 9/2006 | Yamamoto | E05B 81/14<br>292/201 |
| 2006/0267350 | A1 * | 11/2006 | Ichinose | E05B 81/14<br>292/201 |
| 2009/0241617 | A1 * | 10/2009 | Takahashi | E05B 81/16<br>70/257 |

* cited by examiner

OPENING-AND-CLOSING DEVICE FOR VEHICLE DOOR

CROSS-REFERENCE TO RELATED APPLICATION(S)

The present application claims priority to and incorporates by reference the entire contents of Japanese Patent Application No. 2014-142223 filed in Japan on Jul. 10, 2014.

BACKGROUND OF THE INVENTION

1. Field of the Invention

The present invention relates to an opening-and-closing device for vehicle door operated to release a close-latch mechanism for locking a vehicle door with an electric-powered releasing mechanism.

2. Description of the Related Art

Conventionally, an opening-and-closing device for vehicle door is used which includes a latch mechanism (close-latch mechanism) including a latch for holding a door closed by engagement with a striker, and a ratchet engaged with the latch, and an electric-powered releasing mechanism mechanically coupled to the ratchet, and including a driving source such as a motor.

In such a configuration, when electrical trouble such as failure or fixing of a motor occurs, while release operation for releasing the engagement with the close-latch mechanism is performed by the electric-powered releasing mechanism, the ratchet is sometimes restrained in a release operation state (hereinafter, this state is referred to as "release restrained state"). When the ratchet is once captured in the release restrained state, the ratchet cannot mesh with the latch, and the door cannot be held at a closed position.

In order to overcome such a shortcoming, a configuration is proposed for canceling the release restrained state by inserting a tool from an access hole opened in a vehicle interior or manually operating a knob provided in the vehicle interior, when the release restrained state occurs (e.g., see Japanese Patent No. 4428047 or Japanese Patent Application Laid-open No. JP 2005-213818).

In the related art, special manual operation is required to cancel the release restrained state. Therefore, a user needs to previously know a cancellation method for the release restrained state, but when the user does not know the cancellation method, the user needs to see a vehicle manual or the like, and the door cannot be promptly closed.

SUMMARY OF THE INVENTION

It is an object of the present invention to at least partially solve the problems in the conventional technology.

According to one aspect of the present invention, there is provided an opening-and-closing device for vehicle door including: a close-latch mechanism that is provided to a door, the close-latch mechanism including a first latch configured to move from an unlatched position to a latched position and a first ratchet configured to engage with the first latch in the latched position to hold the door in a closed position; an electric-powered releasing mechanism that is configured to operate the first ratchet to a release position; an association mechanism that is configured to operate in a cancellation direction from an initial position in association with opening operation of the door; a relay mechanism that is configured to switch from a connection state to a disconnection state to allow returning of the first ratchet stopped at the release position, the connection state connecting a release operation transmission path configured to transmit release operation of the electric-powered releasing mechanism to the first ratchet, the disconnection state disconnecting the release operation transmission path, the connection state switching to the disconnection state by operation of the association mechanism in the cancellation direction; an electric open/close unit that is configured to operate the door to be opened and closed with electric power; and a control unit that is configured to reversely control the electric open/close unit, operate the door to be opened toward the fully opened position, operate the association mechanism in the cancellation direction, and switch the relay mechanism to the disconnection state, upon detection of operational malfunction of the electric-powered releasing mechanism during closing of the door from the fully opened position to a fully closed position by closing operation of the electric open/close unit.

According to another aspect of the present invention, the opening-and-closing device for vehicle door further includes an open-latch mechanism that is provided to the door, the open-latch mechanism including a second latch configured to move from an unlatched position to a latched position and a second ratchet configured to engage with the second latch in the latched position to hold the door in an opened position. The association mechanism is operated in the cancellation direction in association with the movement of the second latch from the unlatched position to the latched position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A preferable embodiment of an opening-and-closing device for vehicle door according to the present invention will be described in detail with reference to the accompanying drawings.

Figure 1:
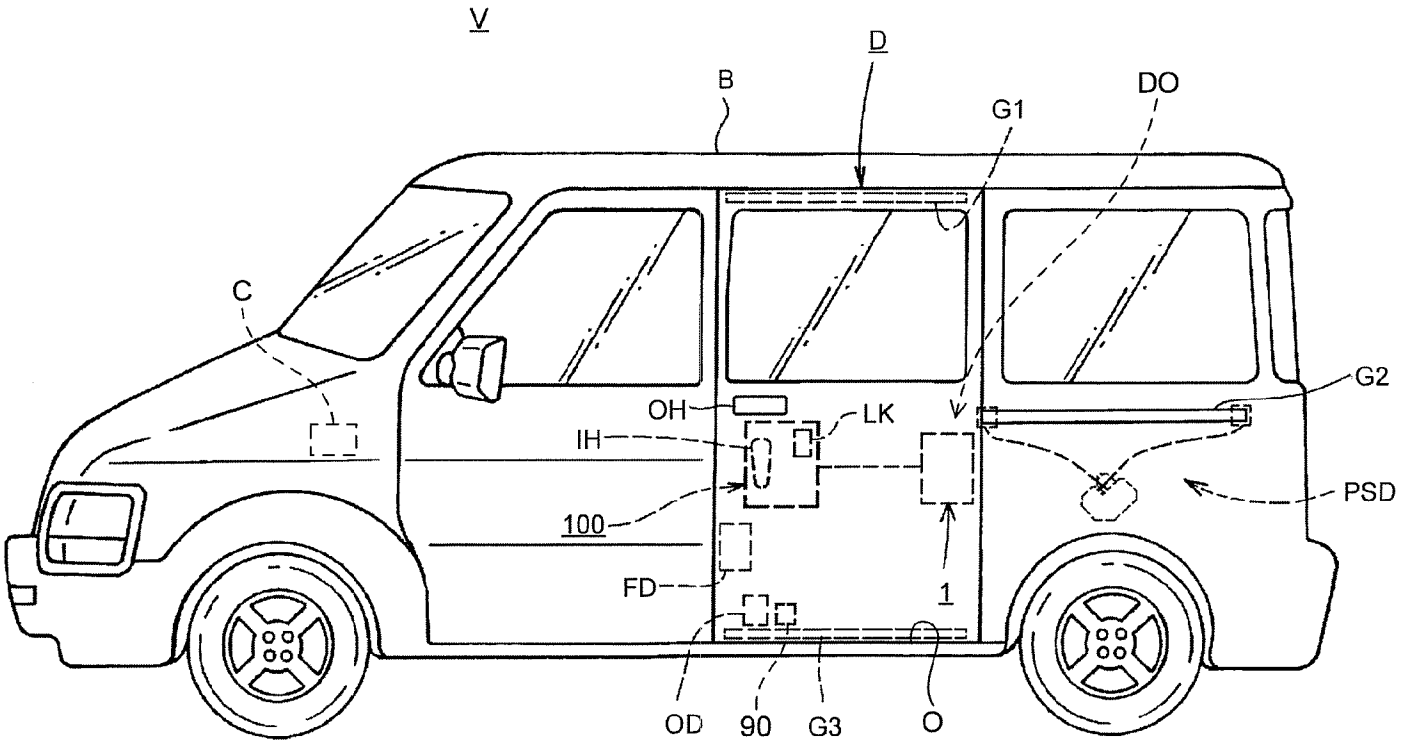
FIG. 1 is a side view of a vehicle including an opening-and-closing device for vehicle door according to one embodiment of the present invention.

1. Description of Whole Configuration of Opening-and-Closing Device for Vehicle Door FIG. 1 is a side view of a vehicle V including the opening-and-closing device for vehicle door DO according to one embodiment of the present invention. As illustrated in FIG. 1, the vehicle V includes a door D for opening and closing a door opening O opened in a side face of a vehicle body B. The door D is a sliding door supported to be opened and closed back and forth by an upper guide rail G1, a waist guide rail G2, and a lower guide rail G3 which are fixed back and forth at the vehicle body B. The vehicle body B has a side face having an inside provided with an electric open/close unit PSD for opening and closing the door D with electric power.

The door D has an outside face provided with an outside handle OH operated to open and close the door D from outside the vehicle. The door D has an inside face provided with an inside handle IH operated to open and close the door D from inside the vehicle, and a locking knob LK operated to manually switch an operation relay device 100 between an unlocked state and a locked state. The door D has a front part provided with a front door latch device FD for holding the door D at a closed position. The door D has a lower part provided with a full open latch device OD for holding the door D at a fully opened position, and an open latch association mechanism 90 for outputting release cancellation operation for canceling a below-mentioned release restrained state. The door D has a back part provided with a rear door latch device 1 for holding the door D at the closed position with the front door latch device FD.

The operation relay device 100 is provided in the door D. The operation relay device 100 controls to relay manual operation of the outside handle OH and the inside handle IH and electrical operation by release drive of a motor 32 (see FIG. 2). The operation relay device 100 transmits each relay-controlled operation to the rear door latch device 1, the front door latch device FD, and the full open latch device OD.

2. Description of Rear Door Latch Device

Figure 2:
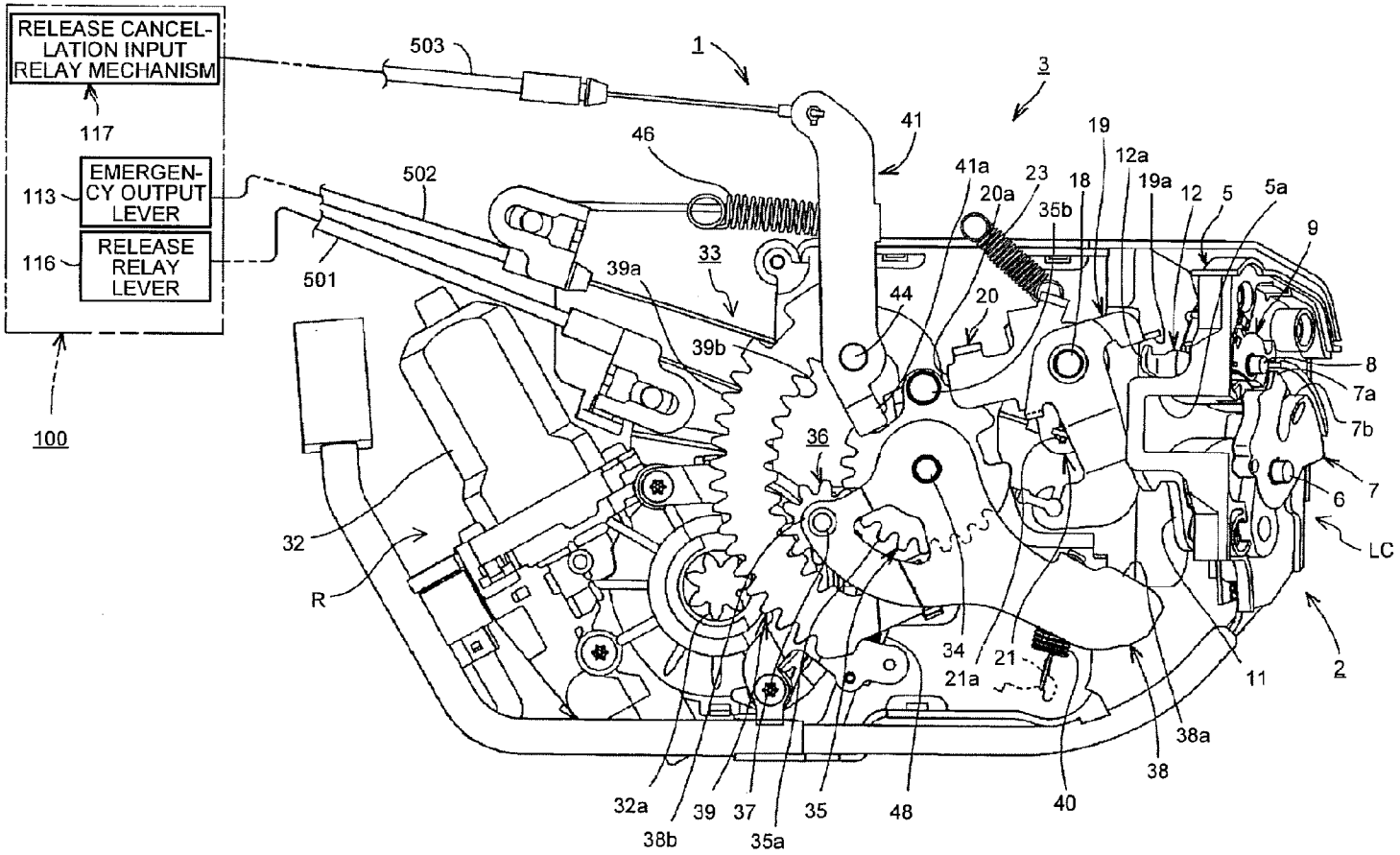
FIG. 2 is a side view of a rear door latch device viewed from inside the vehicle.

FIG. 2 is a side view of the rear door latch device 1 viewed from inside the vehicle. As illustrated in FIG. 2, the rear door latch device 1 includes a latch unit 2, and a closer/release unit 3. The latch unit 2 is a mechanism meshed with a striker S1 (see FIG. 4) provided on the vehicle body B side and holding the door D at the closed position. The closer/release unit 3 has a closing function and releasing function with respect to the door D.

2.1 Description of Latch Unit

Figure 3:
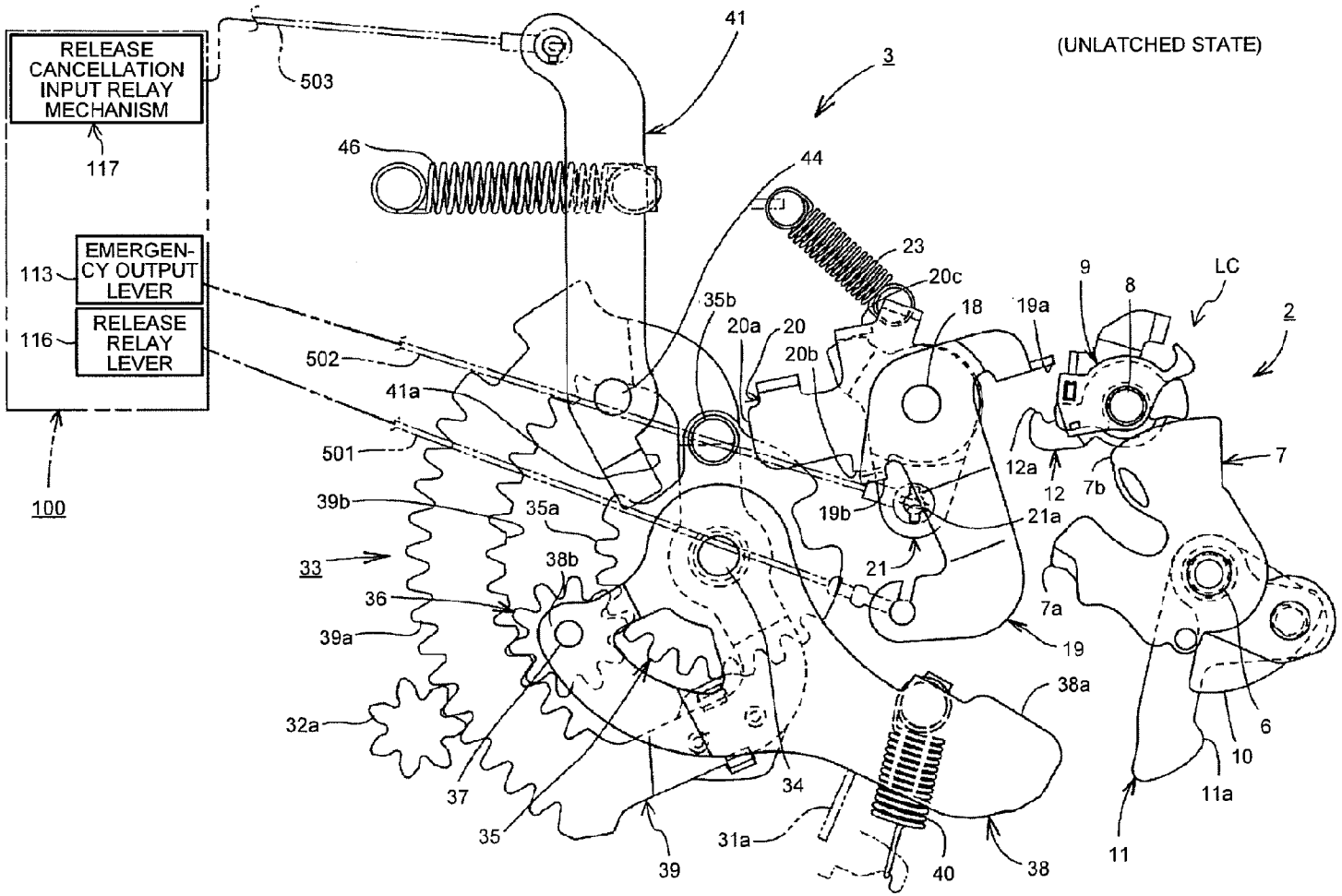
FIG. 3 is a schematic diagram illustrating an unlatched state of the rear door latch device.

As illustrated in FIGS. 2 and 3, the latch unit 2 stores a close-latch mechanism LC including a latch (first latch) 7 and a ratchet (first ratchet) 9 on the inside of a housing 5 mounted to the door D. The latch 7 is supported by a latch shaft 6 directed back and forth, and meshes with the striker S1 when the door D is closed. The ratchet 9 is supported by a ratchet shaft 8 directed back and forth, and is selectively engaged with a full-latch engagement portion 7*a* or a half-latch engagement portion 7*b* provided on the outer periphery of the latch 7. The housing 5 storing the close-latch mechanism LC has an opening closed by a cover plate not illustrated. The latch unit 2 is mounted to the door D through the cover plate.

When the latch 7 is turned by a predetermined angle in a closing direction (clockwise direction in FIG. 5) against an urging force of a spring (not illustrated) externally fitted around the latch shaft 6, from an unlatched position (see FIG. 3) removed from the striker S1, the latch 7 is positioned at a half-latched position (see FIG. 4) at which the latch 7 is slightly meshed with the striker S1. When the latch 7 is further turned in the closing direction, the latch 7 is positioned at a fully latched position (see FIG. 6) at which the latch 7 is fully meshed with the striker S1. The fully latched position of the latch 7 corresponds to a fully closed position of the door D.

The housing 5 has a front face side disposed with a detection lever 10 and a latch lever 11 supported by the latch shaft 6, and turned integrally with the latch 7, and an opening lever 12 supported by the ratchet shaft 8, and turned integrally with the ratchet 9 (see FIG. 3).

Figure 4:
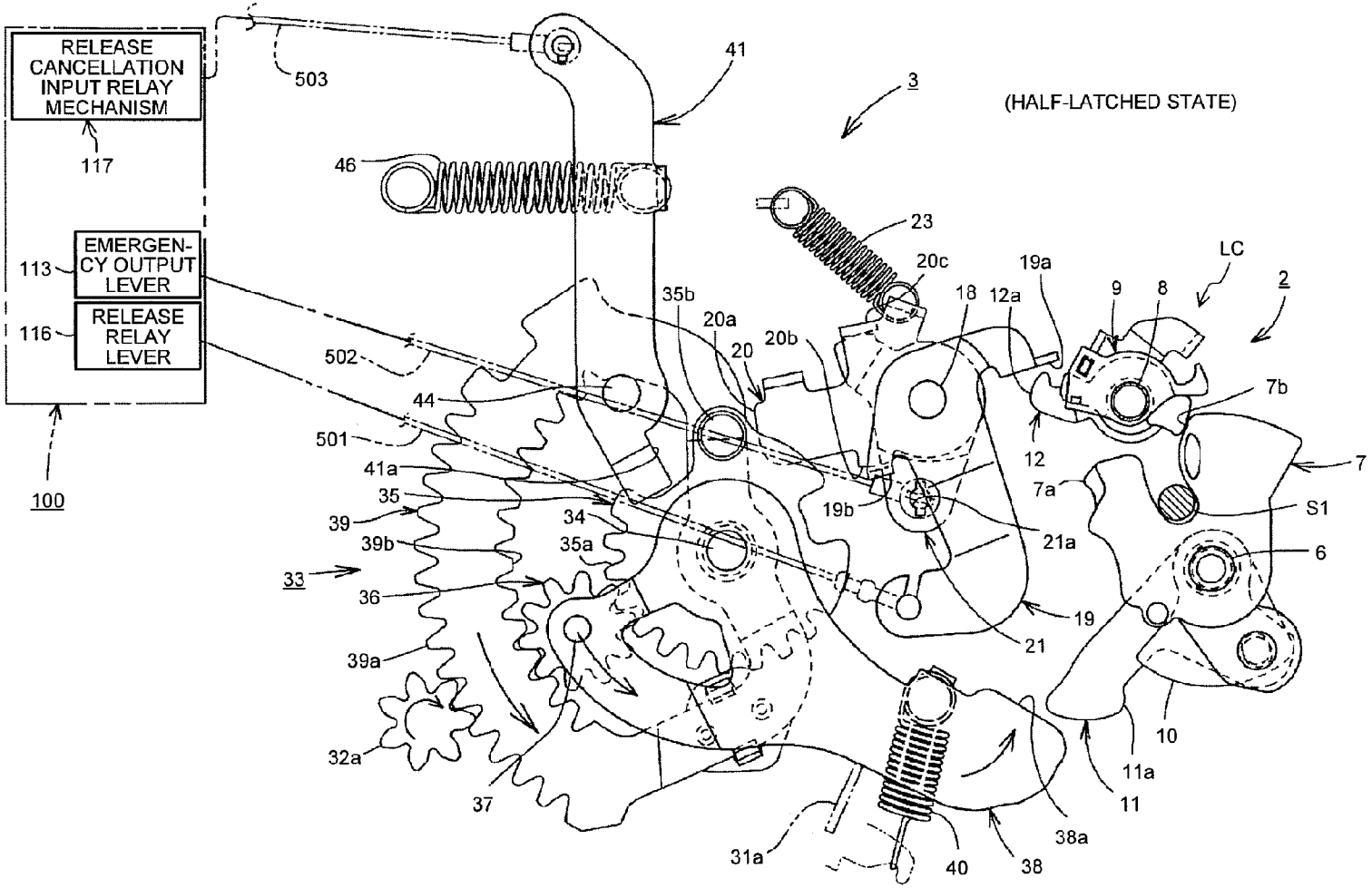
FIG. 4 is a schematic diagram illustrating a half-latched state of the rear door latch device.
Figure 5:
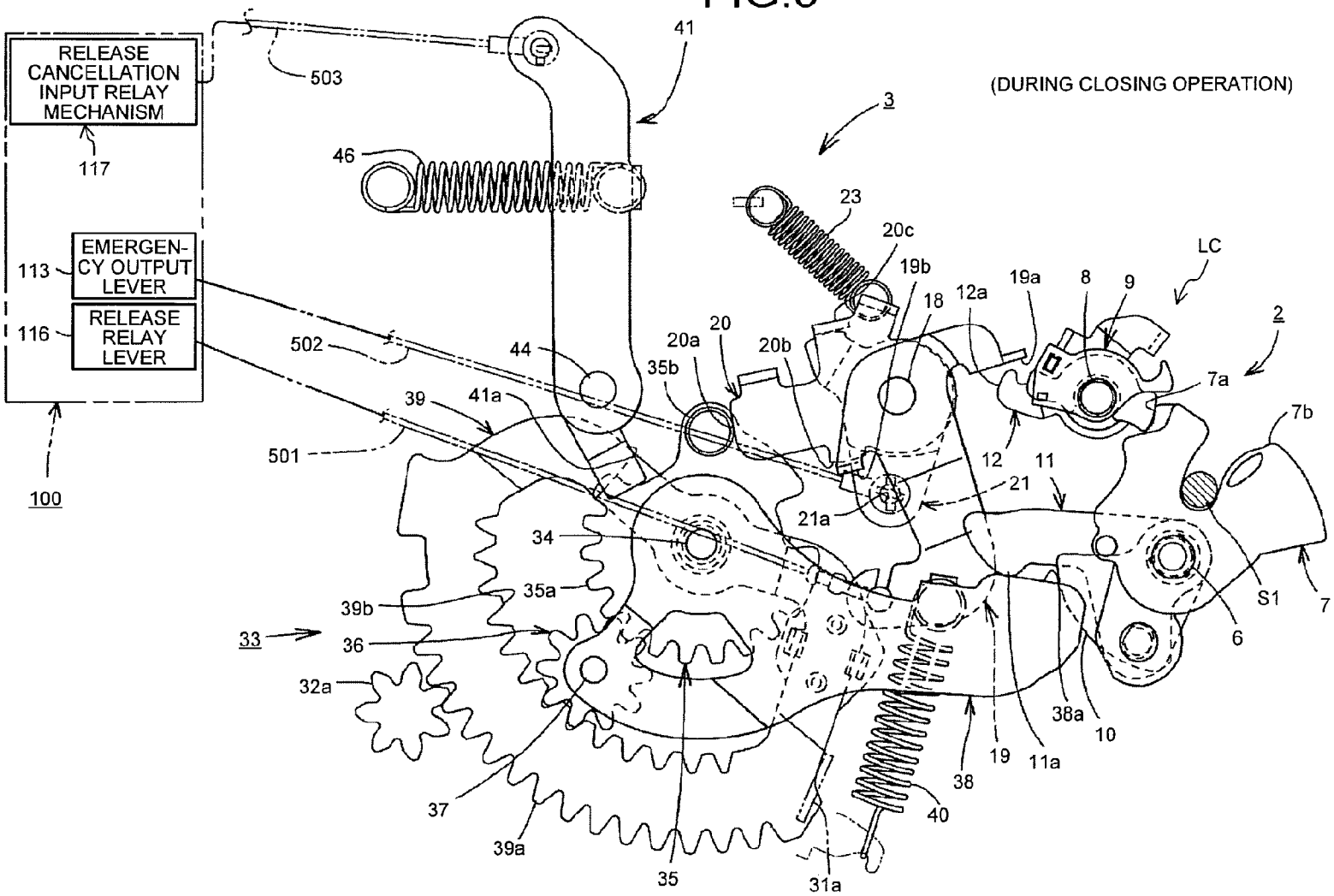
FIG. 5 is a schematic diagram illustrating a state of the rear door latch device during closing operation.

The latch lever 11 is turned integrally with the latch 7. As illustrated in FIG. 3, the latch lever 11 is configured such that an operation portion 11*a* provided at an end is retracted outside a movement trajectory of a closing portion 38*a* of a closing lever 38, when the latch 7 is positioned at the unlatched position. As illustrated in FIG. 4, the latch lever 11 is configured such that the operation portion lie enters the movement trajectory of the closing portion 38*a*, when the latch 7 is turned to the half-latched position.

The half-latched position and the fully latched position of the latch 7 are detected by a half-latch detection switch and a full-latch detection switch, which are not illustrated, respectively. Detection signals of the switches are transmitted to a control unit (ECU) C (see FIG. 1) installed in the vehicle V to trigger stop control and drive control of the motor 32 of the closer/release unit 3 and the electric open/close unit PSD.

The ratchet 9 is normally urged in an engagement direction (e.g., clockwise direction in FIG. 4) integrally with the opening lever 12 by the urging force of the spring not illustrated. When the latch 7 is positioned at the unlatched position illustrated in FIG. 3, the ratchet 9 abuts on the outer periphery of the latch 7. When the latch 7 is positioned at the half-latched position illustrated in FIG. 4, the ratchet 9 is held at an engagement position at which the ratchet 9 is engaged with the half-latch engagement portion 7*b* of the latch 7, and when the latch 7 is positioned at the fully latched position illustrated in FIG. 6, the ratchet 9 is held at an engagement position at which the ratchet 9 is engaged with the full-latch engagement portion 7*a* of the latch 7.

Figure 6:
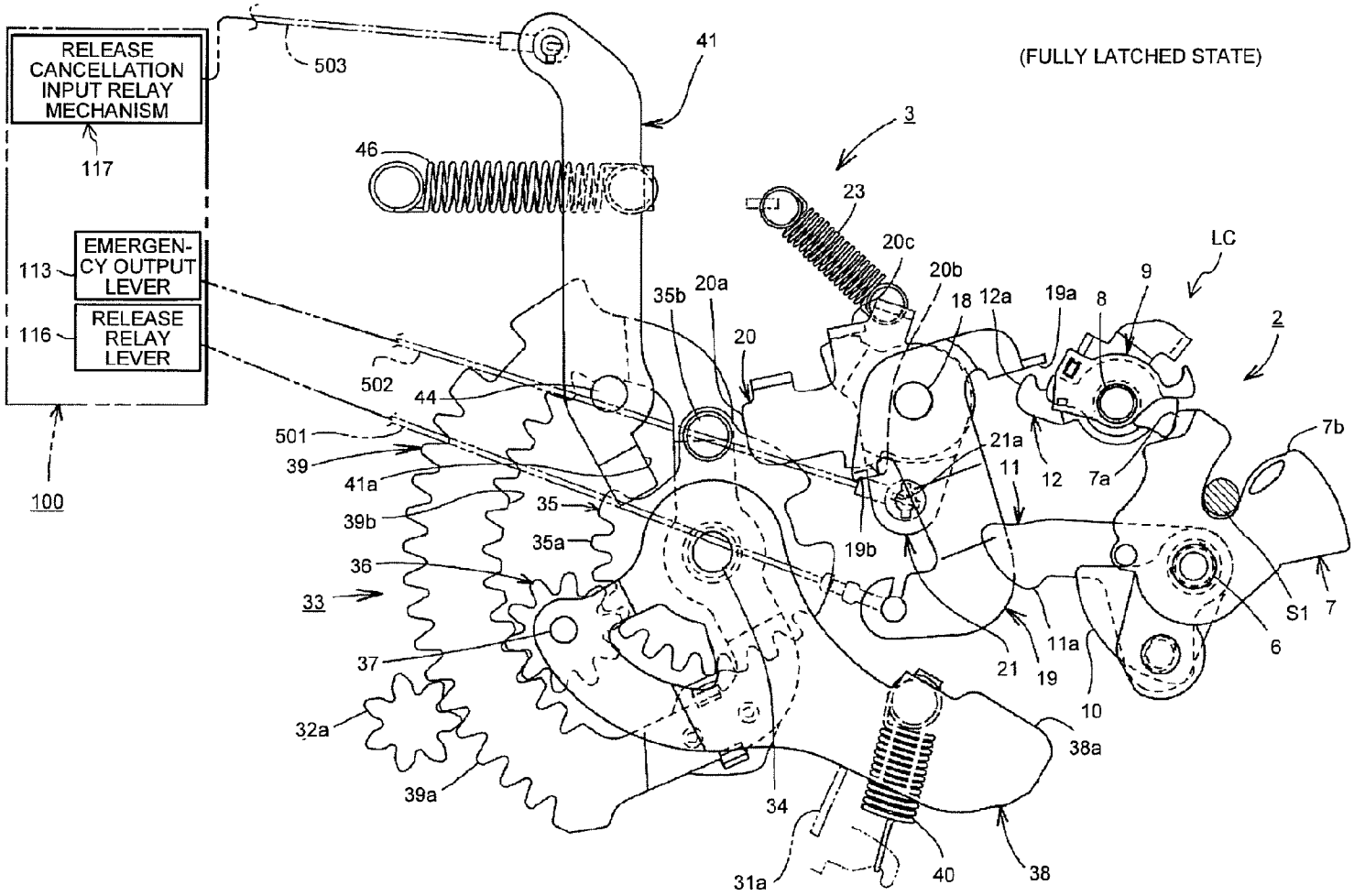
FIG. 6 is a schematic diagram illustrating a fully latched state of the rear door latch device.
Figure 7:
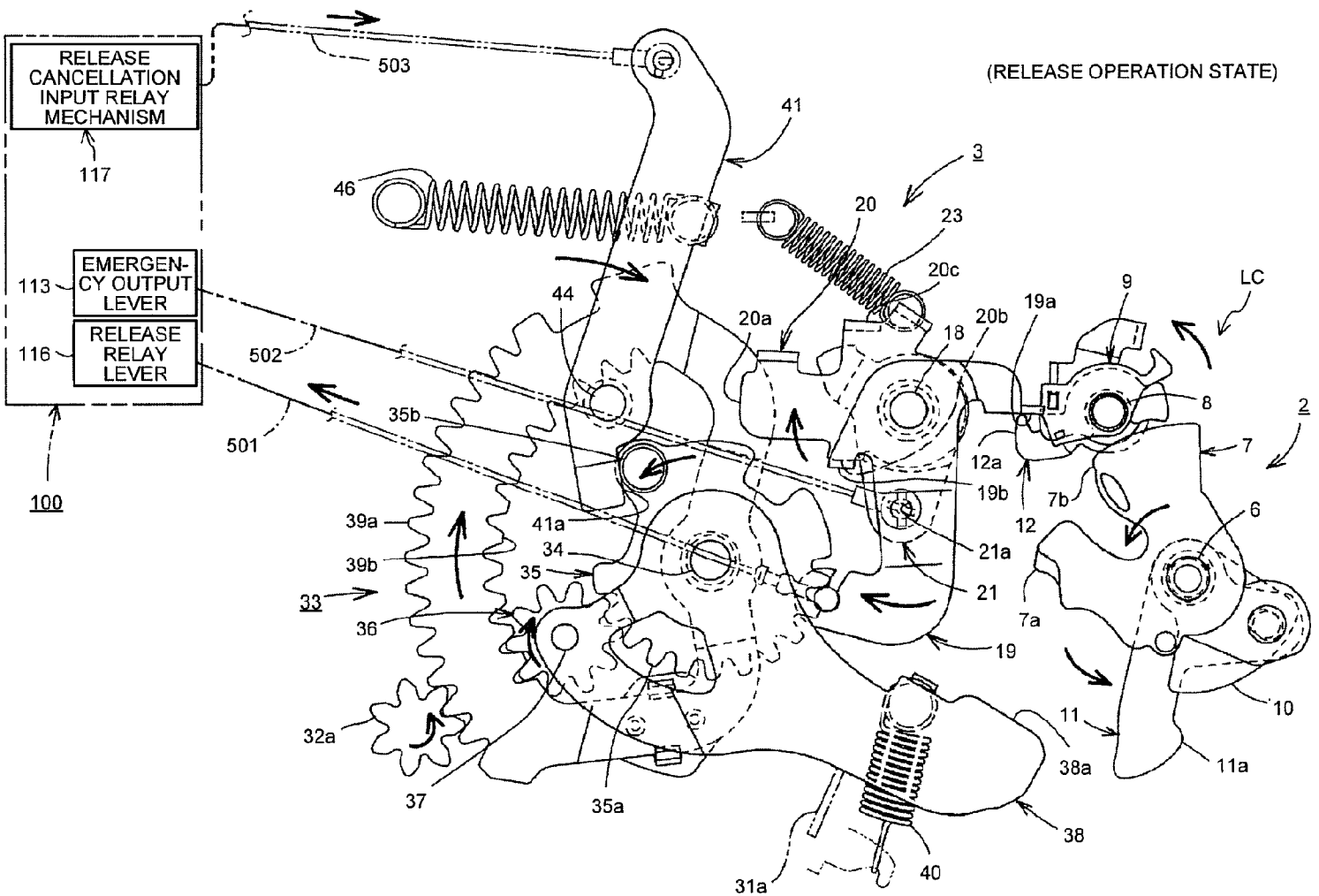
FIG. 7 is a schematic diagram illustrating a release operation state of the rear door latch device.

Upon door opening operation of the outside handle OH or the inside handle IH while the ratchet 9 is positioned at the engagement position at which the ratchet 9 is engaged with the full-latch engagement portion 7*a* of the latch 7, the ratchet 9 is turned in a release direction (counterclockwise direction in FIGS. 4 and 6) through various elements, and moved to a release position illustrated in FIG. 7. Therefore, the ratchet 9 disengages from the full-latch engagement portion 7*a* of the latch 7, the latch 7 is turned in an opening direction, and the door D can be opened.

As illustrated in FIGS. 2 and 3, on the cover plate of the latch unit 2, a release input lever 19, a blocking lever 20, and an emergency input lever 21 are turnably supported by a support shaft 18 directed inward and outward the vehicle.

The release input lever 19 is coupled to a release relay lever 116 of the operation relay device 100 through a cable 501 disposed in the door D. The cable 501 is for example a Bowden cable of transmitting an operation force, and the below-mentioned cables 502, 503, 504, 506, and 507 are also the Bowden cables similarly. Upon the door opening operation of the outside handle OH or the inside handle IH or upon release operation of an electric-powered releasing mechanism R including the motor 32, the release input lever 19 is turned in a release direction (clockwise direction in FIGS. 4 and 6) from a standby position through each element including the release relay lever 116, against an urging force of a spring 23. Therefore, a release portion 19*a* presses down an arm portion 12*a* of the opening lever 12 to move the ratchet 9 to the release position, and the door D can be opened as described above.

The blocking lever 20 is held at a blocking position illustrated in FIGS. 3 to 6 by the urging force of the spring 23. When the release input lever 19 is moved to a release position (position illustrated in FIG. 7), a bent portion 19*b* abuts on a lower bent portion 20*b* from below, and the blocking lever 20 is turned by a predetermined angle in the clockwise direction from the blocking position to a cancel position illustrated in FIG. 7.

The emergency input lever 21 has a lower part provided with a coupling portion 21*a* coupled to an emergency output lever 113 of the operation relay device 100 through the cable 502 disposed in the door D. The emergency input lever 21 is configured such that, upon opening operation of the outside handle OH or the inside handle IH, the blocking lever 20 is moved to the cancel position, and closing operation of the closer/release unit 3 can be interrupted.

2.2 Description of Closer/Release Unit

As illustrated in FIGS. 2 and 3, the closer/release unit 3 includes the motor 32 for closer or release, a planetary gear mechanism 33 as a deceleration mechanism, and a release output lever 41. Power of the motor 32 is decelerated by being transmitted to the planetary gear mechanism 33 through an output gear 32*a*, and the release output lever 41 is operated. The motor 32, the planetary gear mechanism 33, and the release output lever 41 constitute the electric-powered releasing mechanism R for release operation of the ratchet 9.

The release output lever 41 is supported by a shaft 44, and normally urged by a spring 46 in a counterclockwise direction in FIGS. 2 and 3, and held at a standby position illustrated in FIGS. 3 to 6. When a sun gear 35 is turned in a release direction (counterclockwise direction in FIGS. 3 to 6) by release drive of the motor 32, in association with the turning, the release output lever 41 is turned by a predetermined angle in a release direction (clockwise direction in FIGS. 3 to 6) from the standby position (hereinafter, referred to as "release operation").

The release output lever 41 has an upper end coupled, through the cable 503, to a relay lever 118 (see FIG. 15) of a release cancellation input relay mechanism 117 (hereinafter, also referred to as "relay mechanism 117") of the operation relay device 100.

The planetary gear mechanism 33 includes the sun gear 35, a planetary gear 36, the closing lever 38, and a sector gear 39. The sun gear 35 is supported by a support shaft 34. The sun gear 35 has an externally toothed gear 35*a* meshed with the planetary gear 36, on the outside of a fan-shaped circumference thereof, and has a columnar abutment portion 35*b* projecting inside the vehicle, on an upper rotation face on which the externally toothed gear 35*a* is not formed. The planetary gear 36 is meshed with the sun gear 35 rotatably and revolvably. The closing lever 38 is supported by the support shaft 34. The closing lever 38 supports the planetary gear 36 on a shaft 37. The sector gear 39 is supported by the support shaft 34. The sector gear 39 has an externally toothed gear 39*a* meshed with the output gear 32*a* on the outside of the circumference thereof, and an internally toothed gear 39*b* meshed with the planetary gear 36 on the inside of the circumference thereof.

In a half-latched state illustrated in FIG. 4, when the sun gear 35 is slightly turned in a clockwise direction from a neutral position, the abutment portion 35*b* abuts on a blocking portion 20*a* to block the turning of the sun gear 35 in a clockwise direction, and closing drive of the motor 32 can be transmitted to the latch 7. Further, when the blocking lever 20 is moved to the cancel position (position illustrated in FIG. 7) during the closing drive of the motor 32, the blocking portion 20*a* is retracted outside a movement trajectory of the abutment portion 35*b*, the closing drive of the motor 32 is not transmitted to the latch 7, and the closing operation is canceled.

When the planetary gear mechanism 33 is in a neutral state (e.g., a state illustrated in FIG. 5), the closing lever 38 is urged in a clockwise direction by a spring 40, and held at a standby position where the closing lever 38 abuts on a stopper portion 31*a* (see FIG. 3) from above. In this state, the sector gear 39 is set to a neutral position where the externally toothed gear 39*a* is directed forward. The neutral position of the sector gear 39 is detected by a detection switch 48 disposed under the sector gear 39, and the detection is transmitted to the control unit C.

2.3 Description of Closing Operation of Closer/Release Unit

When the door D in an opened state is moved to a half-shut position by power of the electric open/close unit PSD, and the striker S1 enters a striker entrance groove 5*a* of the housing 5 to mesh with the latch 7, the close-latch mechanism LC is changed from an unlatched state illustrated in FIG. 3 to a half-latched state illustrated in FIG. 4. When the half-latched position of the latch 7 is detected by the half-latch detection switch, the motor 32 is subjected to closing control (normal rotation control) by the control unit C. Therefore, the closing drive of the motor 32 turns the output gear 32*a* in a direction indicated by an arrow (clockwise direction) illustrated in FIG. 4. In this operation, turning of the sun gear 35 in the clockwise direction is inhibited by the blocking portion 20*a* of the blocking lever 20 positioned at the blocking position. Therefore, the sector gear 39 is turned about the support shaft 34 in a closing direction (counterclockwise direction) indicated by an arrow illustrated in FIG. 4, and the closing lever 38 is turned in a closing direction (counterclockwise direction) indicated by an arrow illustrated in FIG. 4, against an urging force of the spring 40, with the revolution of the planetary gear 36. Therefore, the closing portion 38*a* is moved upward, the operation portion 11*a* of the latch lever 11 is pressed upward, and the latch 7 is turned to the fully latched position illustrated in FIG. 5. When the fully latched position of the latch 7 is detected by the full-latch detection switch, the motor 32 is once controlled to be stopped by the control unit C, and then reversely controlled.

When the motor 32 is controlled to be reversely rotated, the closing lever 38 is reversely rotated by receiving a turning force caused by the revolution of the planetary gear 36 and the urging force of the spring 40, and returns to the standby position, as illustrated in FIG. 6. When the neutral position of the sector gear 39 is detected by the detection switch 48, the control unit C controls the motor 32 to be stopped. Accordingly, the planetary gear mechanism 33 is returned to the neutral state before operation, and a sequence of closing operation is completed.

2.4 Description of Release Operation of Closer/Release Unit

Upon release drive of the motor 32 based on the operation of an operation switch provided at the vehicle V or a portable wireless operation switch, while the close-latch mechanism LC is in the half-latched state or a fully latched state illustrated in FIG. 4 or 6 respectively, the sector gear 39 is turned about the support shaft 34 in a release direction (clockwise direction), and the planetary gear 36 rotates in a clockwise direction without revolution. Accordingly, the sun gear 35 is turned by a predetermined angle in the release direction (counterclockwise direction), and the abutment portion 35*b* presses a release portion 41*a* of the release output lever 41, and turns the release output lever 41 in the clockwise direction, for release operation (see FIG. 7).

Such a release operation of the electric-powered releasing mechanism R is transmitted to the ratchet 9 through various elements such as the operation relay device 100, and the ratchet 9 is turned from the engagement position to the release position. Therefore, the door D can be opened. After the end of the release operation, the motor 32 is reversely controlled, and the release output lever 41 and the various elements in association with the release operation of the release output lever 41 are returned to their standby positions.

3. Description of Full Open Latch Device and Open Latch Association Mechanism

Figure 9:
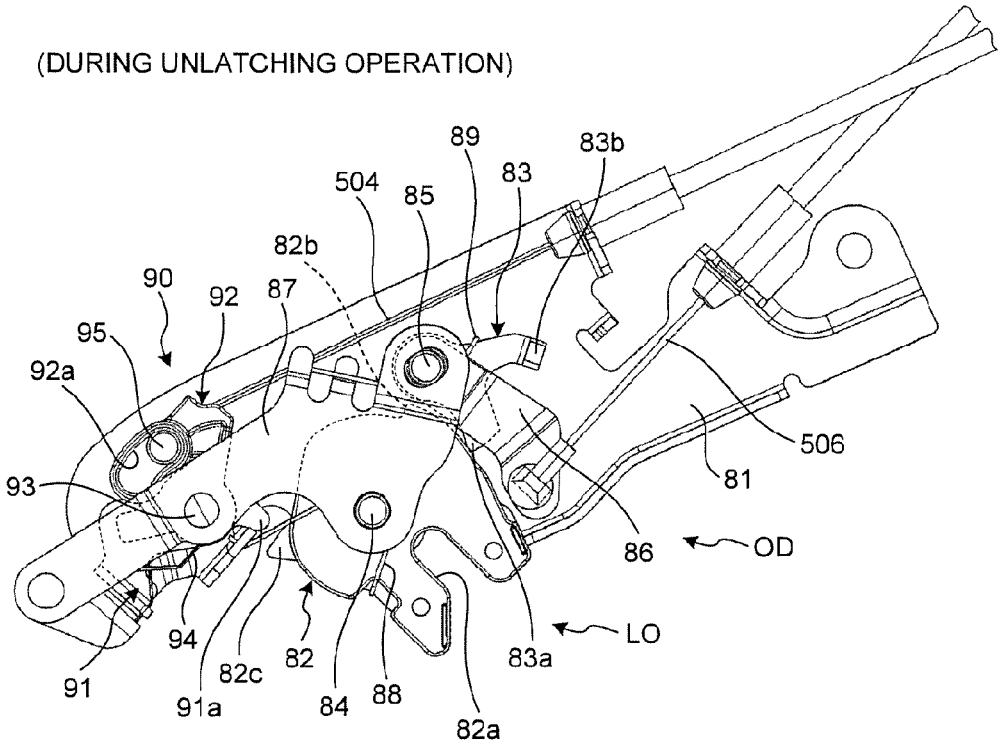
FIG. 9 is a plan view of a full open latch device and an open latch association mechanism.

FIG. 9 is a plan view of the full open latch device OD and an open latch association mechanism 90, in which the door D is positioned at the fully closed position.

3.1 Description of Full Open Latch Device

Figure 13:
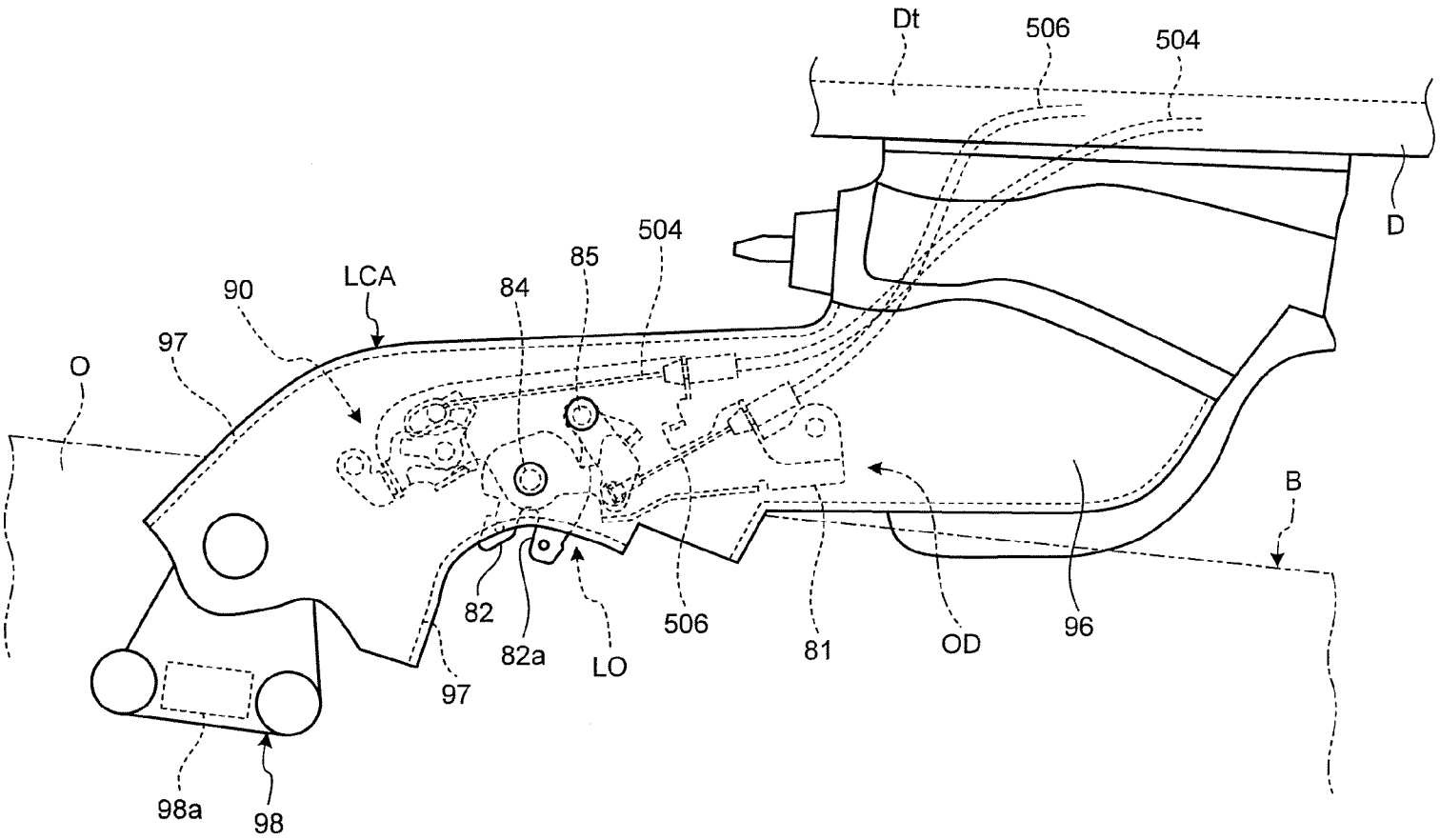
FIG. 13 is a plan view of a lower arm.
Figure 14:
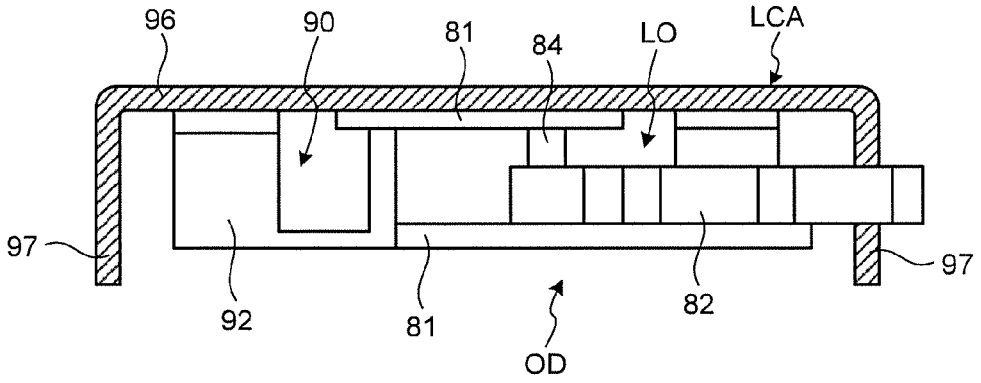
FIG. 14 is a cross-sectional view of the lower arm.

The full open latch device OD is a device meshed with a striker S2 (see FIGS. 10 and 11) provided on the vehicle body B side to hold the door D at the fully opened position. As illustrated in FIG. 9, the full open latch device OD has a metal base plate 81. The base plate 81 has an inner face side provided with an open-latch mechanism LO including a full open latch (second latch) 82 and a ratchet (second ratchet) 83. The full open latch device OD is mounted on the lower face of a lower arm LCA (FIGS. 13 and 14). The lower arm LCA is a metal bracket slidably supporting the door D relative to the door opening O.

The full open latch 82 is supported by a vertical latch shaft 84, and meshes with the striker S2 in an engagement groove 82*a* when the door D is fully opened. A ratchet 83 is supported by a vertical ratchet shaft 85, and is engaged with an engagement portion 82*b* provided on the outer periphery of the full open latch 82. A release input lever 86 is supported on the ratchet shaft 85 so as to be overlapped with the ratchet 83. The latch shaft 84 and the ratchet shaft 85 each have one end held on the base plate B1, and the other end held on a support plate 87. On the outer periphery of the full open latch 82, a projection 82*c* is projectingly provided at a position adjacent to the open latch association mechanism 90 relative to the engagement portion 82*b*.

Figure 10:
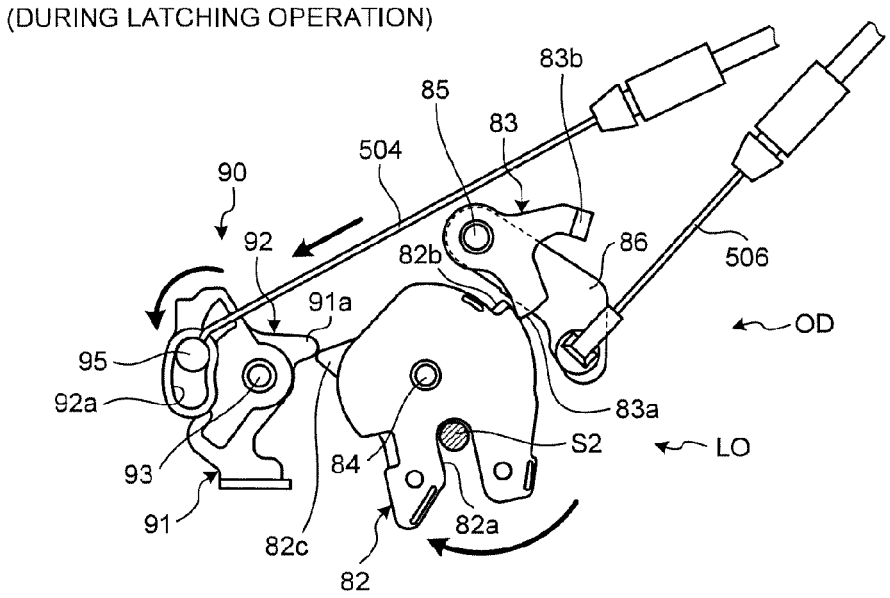
FIG. 10 is a schematic diagram illustrating a state of the full open latch device and the open latch association mechanism during latching operation.

When the full open latch 82 is turned by a predetermined angle in a latching direction (clockwise direction in FIG. 9) from the unlatched position (see FIG. 9) at which the full open latch 82 is removed from the striker S2, against an urging force of a spring 88 externally fitted around the latch shaft 84, the full open latch 82 is positioned at a position where the full open latch 82 is slightly meshed with the striker S2 (see FIG. 10). When the full open latch 82 is further turned in the latching direction, the full open latch 82 is positioned at a latched position (see FIG. 11) completely meshing with the striker S2. The latched position of the full open latch 82 corresponds to a fully opened state of the door D.

The ratchet 83 is normally urged in an engagement direction (e.g., clockwise direction in FIG. 9) by an urging force of a spring 89 externally fitted around the ratchet shaft 85. The ratchet 83 has a pawl portion 83*a* and a bent portion 83*b* at the ends of portions projecting in two directions substantially into a V-shape from the ratchet shaft 85. When the full open latch 82 is positioned at the unlatched position illustrated in FIG. 9, the pawl portion 83*a* abuts on the outer periphery of the full open latch 82. When the full open latch 82 is positioned at the latched position illustrated in FIG. 11, the pawl portion 83*a* is held at an engagement position at which the pawl portion 83*a* is engaged with the engagement portion 82*b* of the full open latch 82, and the full open latch 82 is inhibited from turning in an unlatching direction (counterclockwise direction in FIG. 11). When the ratchet 83 is positioned at the engagement position at which the ratchet 83 is engaged with the engagement portion 82*b* of the full open latch 82, a meshing state between the full open latch 82 and the striker S2 is held, and the door D is held in the fully opened state.

The release input lever 86 is coupled to a closing inside lever 111 of the operation relay device 100 (see FIG. 15) through the cable 506 disposed into the door D along the lower face of the lower arm LCA.

Figure 12:
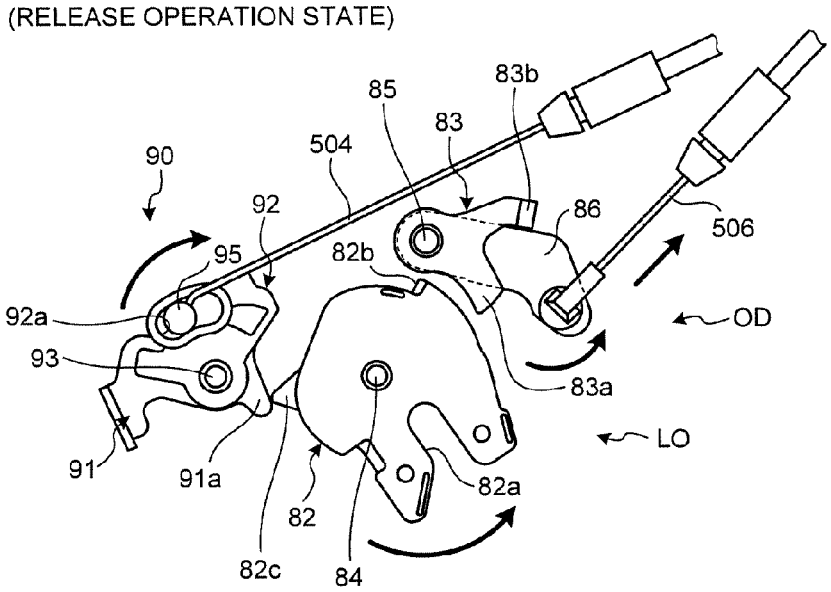
FIG. 12 is a schematic diagram illustrating a release operation state of the full open latch device and the open latch association mechanism.

Upon door closing operation of the inside handle IH while the door D is in a fully opened state, and the operation relay device 100 is in a unlocked state, the closing inside lever 111 is operated to be released. The release operation is transmitted to the release input lever 86 through the cable 506, and the release input lever 86 is turned in a release direction (counterclockwise direction), as illustrated in FIG. 12. Accordingly, a side edge of the release input lever 86 presses the bent portion 83*b* of the ratchet 83, so that the ratchet 83 is turned in a counterclockwise direction, as illustrated in FIG. 12, and is moved to a release position. Therefore, an engagement state between the full open latch 82 and the ratchet 83 is released, and the full open latch 82 is turned in the unlatching direction by the urging force of the spring 88 to be positioned at the unlatched position.

3.2 Description of Open Latch Association Mechanism

As illustrated in FIG. 9, the open latch association mechanism (release cancellation output mechanism) 90 and the open-latch mechanism LO are provided side by side on the inner face of the base plate 81 of the full open latch device OD. The release cancellation operation of the open latch association mechanism 90 is brought about in association with the movement of the full open latch 82 of the open-latch mechanism LO from the unlatched position to the latched position. The release cancellation operation is transmitted to the relay mechanism 117 through the cable 504 (see FIG. 15). When the release cancellation operation from the open latch association mechanism 90 is input, the relay mechanism 117 cancels the release restrained state to close the door D.

The open latch association mechanism (association mechanism) 90 includes a cam lever 91 and a cancellation lever 92.

The cam lever 91 is supported by a vertical shaft 93, and normally urged in a clockwise direction in FIG. 9 by a spring (urging member) 94 externally fitted around the shaft 93. The cam lever 91 has a reception portion 91*a* having an arcuate end projecting toward the full open latch 82. The cancellation lever 92 is turned integrally with the cam lever 91. The cancellation lever 92 has an arcuate elongated hole 92*a* movably receiving insertion of a coupling pin (connection portion) 95 provided at one end of the cable 504. As illustrated in FIG. 9, when the door D is positioned at the closed position, and the full open latch 82 is in an unlatched state, the coupling pin 95 is positioned at a position where the coupling pin 95 abuts on a proximal edge of the elongated hole 92*a*. The cam lever 91 and the cancellation lever 92 may have an integral structure.

When the door D is opened to be moved from the fully closed position, and the full open latch 82 positioned at the unlatched position of FIG. 9 abuts on the striker S2 and is turned in the latching direction (clockwise direction), immediately before the door D is positioned to the fully opened position, the projection 82*c* of the full open latch 82 presses the reception portion 91*a* of the cam lever 91. Therefore, the cam lever 91 and the cancellation lever 92 are turned by a predetermined angle in a cancellation direction (counterclockwise direction), as illustrated in FIG. 10 (hereinafter, referred to as "release cancellation operation"), and the edge of the elongated hole 92*a* draws and moves the coupling pin 95. The movement of the coupling pin 95 transmits the release cancellation operation to a disconnection lever 120 of the relay mechanism 117 (see FIG. 15) through the cable 504. Therefore, the relay mechanism 117 is switched from a connection state to a disconnection state as described below, and a release operation transmission path for transmitting the release operation of the electric-powered releasing mechanism R to the ratchet 9 of the close-latch mechanism LC is disconnected.

It is noted that the release operation transmission path according to the present embodiment is a path connecting the release output lever 41, the cable 503, the relay mechanism 117, a coupling rod 128 (see FIG. 15), a lever mechanism 103 (release relay lever 116) of the operation relay device 100, the cable 501, the release input lever 19, and the ratchet 9, and the relay mechanism 117 of this path is configured to be connected or disconnected.

When the full open latch 82 is further turned in the latching direction (clockwise direction) from a position illustrated in FIG. 10, the projection 82*c* gets over the reception portion 91*a*. Accordingly, as illustrated in FIG. 11, the cam lever 91 and the cancellation lever 92 are returned to initial positions by an urging force of the spring 94, the cable 504 is also returned to an initial position, and the full open latch 82 is engaged with the ratchet 83 to be positioned at the latched position.

Figure 11:
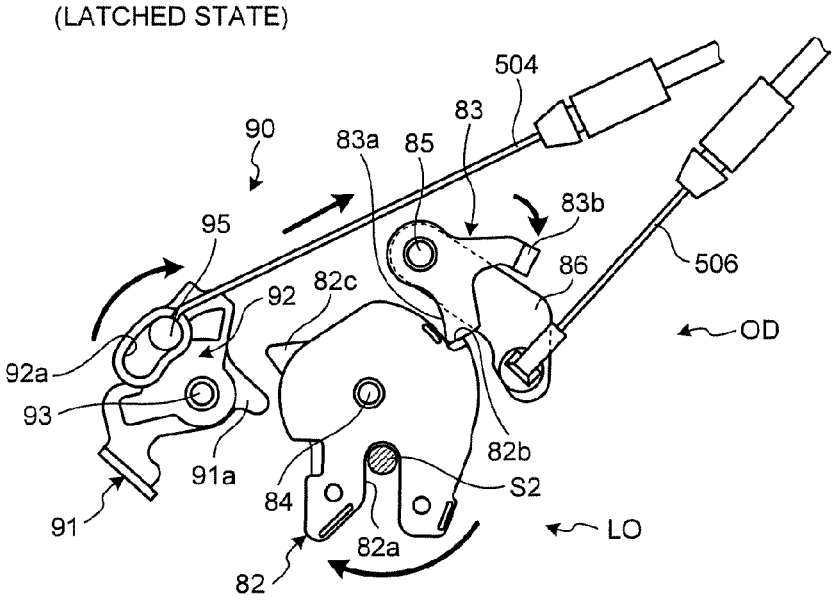
FIG. 11 is a schematic diagram illustrating a latched state of the full open latch device and the open latch association mechanism.

On the other hand, upon the door closing operation of the inside handle IH while the door D is in the fully opened state, the release input lever 86 is turned in the release direction (counterclockwise direction) as illustrated in FIG. 12, from a state illustrated in FIG. 11, through the closing inside lever 111 and the cable 506. Accordingly, the ratchet 83 is moved to the release position, and the full open latch 82 is turned in the unlatching direction by the urging force of the spring 88.

When the full open latch 82 is turned in the unlatching direction, the projection 82*c* of the full open latch 82 presses the reception portion 91*a* of the cam lever 91 as illustrated in FIG. 12, and the cam lever 91 and the cancellation lever 92 are turned by a predetermined angle in the clockwise direction. During this operation, the elongated hole 92*a* of the cancellation lever 92 does not operate the coupling pin 95, the coupling pin 95 is not moved, and a drawing force is not generated in the cable 504.

As described above, the open latch association mechanism 90 generates the release cancellation operation according to the operation of the full open latch 82 during opening operation of the door D, and the release cancellation operation is transmitted to the relay mechanism 117 through the cable 504. On the other hand, in the operation of the full open latch 82 during closing operation of the door D, the release cancellation operation is not generated, and power is not transmitted to the relay mechanism 117.

As illustrated in FIGS. 13 and 14, the lower arm LCA includes a plate 96 disposed along a horizontal direction, and flanges 97 and 97 projecting downward from both side edges of the plate 96. The full open latch device OD and the open latch association mechanism 90 are mounted to positions on the inside of the flanges 97 and 97, on the lower face (back side) of the plate 96.

As illustrated in FIG. 13, the lower arm LCA has one end provided with a swingable slide mechanism 98 having a roller 98*a* sliding on a bottom face of the door opening O of the vehicle body B. The other end of the lower arm LCA is fixed to the door D. The cables 504 and 506 extending from the open latch association mechanism 90 and the full open latch device OD mounted on the lower face of the plate 96 are led to the door D along the lower face of the plate 96, disposed in a door trim Dt, and connected to the operation relay device 100 and the relay mechanism 117, respectively.

As described above, the open latch association mechanism 90 for generating the release cancellation operation for canceling the release restrained state is mounted to the lower face of the lower arm LCA, together with the full open latch device OD. Therefore, the open latch association mechanism 90 can be installed in the vehicle V without obstructing an installation space for various elements, such as the rear door latch device 1 or the relay mechanism 117, installed in the door D. The full open latch device OD and the open latch association mechanism 90 are mounted to the positions on the inside of the flange 97, on the lower face of the plate 96. Therefore, the full open latch device OD and the open latch association mechanism 90 can be concealed inside the flange 97, and can be prevented from, for example, being tramped on and broken upon getting in or out of the vehicle. The cable 504 for coupling the open latch association mechanism 90 and the relay mechanism 117 is disposed into the door trim Dt from the lower face of the lower arm LCA, so that the open latch association mechanism 90 and the relay mechanism 117 can be smoothly operated while the cable 504 is prevented from being exposed to the outside.

4. Description of Operation Relay Device

Figure 15:
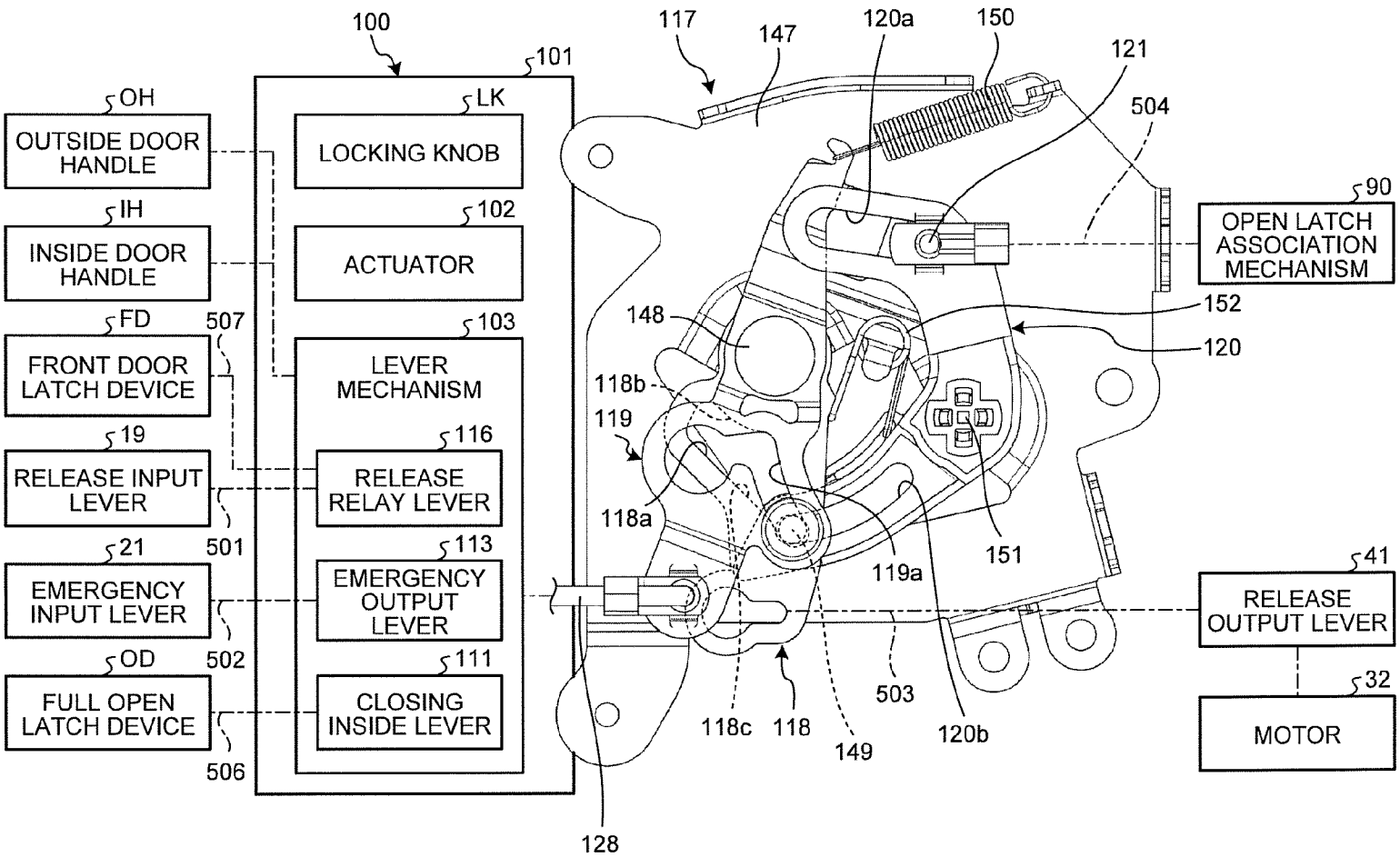
FIG. 15 is a schematic diagram illustrating a configuration of an operation relay device and a release cancellation input relay mechanism.

FIG. 15 is a schematic diagram illustrating a configuration of the operation relay device 100 and the relay mechanism 117. In FIG. 15, the operation relay device 100 is illustrated in a block diagram, and the relay mechanism 117 seen from inside the vehicle is illustrated in a side view.

As illustrated in FIG. 15, the operation relay device 100 includes a metal base plate 101 fixed in the door D. The operation relay device 100 supports a locking knob LK, an actuator 102, and the lever mechanism 103 on the base plate 101.

The locking knob LK is slidably moved between an unlocked position and a locked position by manual operation from inside the vehicle in order to selectively switch the lever mechanism 103 between an unlocked state and a locked state. The lever mechanism 103 can be also switched between the unlocked state and the locked state by driving of the actuator 102. The actuator 102 is operated by unlocking operation and locking operation of the operation switch provided at an appropriate position of the vehicle, or the portable wireless operation switch.

Upon opening operation of the outside handle OH disposed on the outside of the vehicle, a lever group constituting the lever mechanism 103 is appropriately operated, the motor 32 of the electric-powered releasing mechanism R and the electric open/close unit PSD are controlled for opening drive under the control of the control unit C, and the door D is operated to be opened.

The inside handle IH disposed on the inside of the vehicle can be operated to open and close the door D. Upon the opening operation of the inside handle IH, the lever group constituting the lever mechanism 103 is appropriately operated, the motor 32 of the electric-powered releasing mechanism R and the electric open/close unit PSD are controlled for opening drive under the control of the control unit C, and the door D is operated to be opened. Upon the closing operation of the inside handle IH, the lever group constituting the lever mechanism 103 is appropriately operated, the full open latch device OD is operated to be released through the closing inside lever 111 and the cable 506, the electric open/close unit PSD is controlled for closing drive, and the door D is operated to be closed.

The release relay lever 116 is coupled to the release input lever 19 of the rear door latch device 1 and a release lever of the front door latch device FD (not illustrated) through the cables 501 and 507. When the lever mechanism 103 is in the unlocked state, release operation of the release relay lever 116 is transmitted to the release input lever 19 of the rear door latch device 1 and the release lever of the front door latch device FD.

The emergency output lever 113 is coupled to the emergency input lever 21 of the rear door latch device 1 through the cable 502 (see FIG. 3). Upon release operation of the emergency output lever 113, the blocking lever 20 is moved to the cancel position as described above, and the closing operation of the closer/release unit 3 is interrupted.

5. Description of Release Cancellation Input Relay Mechanism

Figure 16:
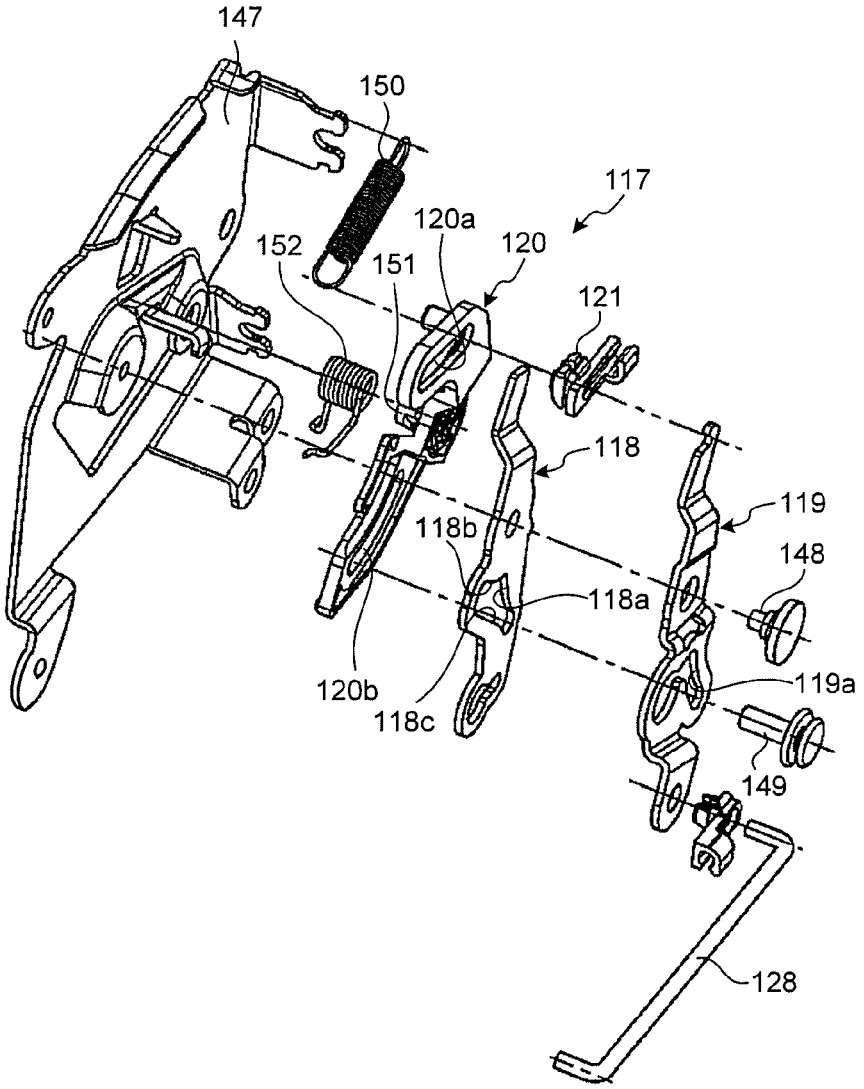
FIG. 16 is an exploded perspective view of the release cancellation input relay mechanism.

As illustrated in FIGS. 15 and 16, the relay mechanism (release transmission mechanism) 117 includes a metal support plate 147. The relay mechanism 117 supports the relay lever 118, a transmission lever 119, and the disconnection lever 120 on the support plate 147. In the present embodiment, the relay mechanism 117 is mounted to the base plate 101 of the operation relay device 100 by the support plate 147. The relay mechanism 117 may be mounted to for example a panel of the door D other than the operation relay device 100.

The relay mechanism 117 can be switched between the connection state in which connection is made to transmit the release operation of the release output lever 41 by the release drive of the motor 32 to the rear door latch device 1 and the front door latch device FD, and the disconnection state in which disconnection is made not to transmit the release operation. When electrical trouble such as failure or fixing of the motor 32 occurs in the electric-powered releasing mechanism R during release drive of the motor 32, and the close-latch mechanism LC remains in the release operation, the release restrained state occurs in which the door D cannot be held. In this condition, the relay mechanism 117 is switched to the disconnection state, the release operation transmission path for transmitting the release operation of the electric-powered releasing mechanism R to the ratchet 9 is disconnected, so that the release restrained state is canceled, and the door D can be held.

The relay lever 118 is supported on the support plate 147 by a shaft 148 directed inside and outside the vehicle. The relay lever 118 has a lower end coupled to the release output lever 41 of the rear door latch device 1 through the cable 503. The relay lever 118 is turned by a predetermined angle in a counterclockwise direction from a standby position illustrated in FIG. 15 (hereinafter, referred to as "release operation") in association with the release operation of the release output lever 41 by the release drive of the motor 32, and is moved to a release position illustrated in FIG. 17.

The relay lever 118 has a lower part Provided with a vertical control hole 118*a*. The control hole 118*a* is a hole portion having a substantially triangular shape. The control hole 118*a* has a non-operating portion 118*b* extending from a vertex (recessed portion) of a substantially L-shaped edge on the disconnection lever 120 side toward the opposite side, and an inclined portion 118*c* gradually inclined downward from an end (terminal end) of the non-operating portion 118*b* toward the disconnection lever 120. A floating pin 149 vertically moved following the operation of the disconnection lever 120 is slidably engaged with the control hole 118*a*.

The transmission lever 119 is supported on the support plate 147 by the same shaft 148 as the relay lever 118. When the disconnection lever 120 is at a connection position illustrated in FIGS. 15 and 17, or the relay mechanism 117 is in the connection state, the transmission lever 119 can be moved in association with release operation of the relay lever 118. The association movement turns the transmission lever 119 by a predetermined angle in a counterclockwise direction together with the relay lever 118, from a standby position illustrate in FIG. 15, against an urging force of a spring 150 (hereinafter, referred to as "release operation"), and the transmission lever 119 is moved to a release position illustrated in FIG. 17.

The transmission lever 119 has a lower end coupled the lever mechanism 103 of the operation relay device 100 through the coupling rod 128. The release operation from the transmission lever 119 is transmitted to the lever mechanism 103 through the coupling rod 128, and this release operation of the lever mechanism 103 is transmitted to the rear door latch device 1 and the front door latch device FD.

The transmission lever 119 has a lower part provided with a vertical elongated hole 119*a*. The floating pin 149 is slidably engaged with the elongated hole 119*a*.

The disconnection lever 120 is a substantially U-shaped lever supported on the support plate 147 by a shaft 151 directed inside and outside the vehicle. The disconnection lever 120 has an upper end coupled to the cancellation lever 92 of the open latch association mechanism 90 through the cable 504. Upon the release cancellation operation of the cancellation lever 92 of the open latch association mechanism 90 in the cancellation direction as described above, the disconnection lever 120 can be moved in association with the release cancellation operation. The association moves the disconnection lever 120 to be turned by a predetermined angle in a clockwise direction from the connection position illustrated in FIG. 15 to a disconnection position illustrated in FIG. 18, against an urging force of a spring 152.

The disconnection lever 120 has an upper end formed with an elongated hole 120*a* slidably receiving insertion of a coupling pin 121 provided at the other end of the cable 504. In the connection position illustrated in FIG. 15 and the disconnection position illustrated in FIG. 18, the coupling pin 121 is positioned at a position where the coupling pin 121 abuts on a proximal edge of the elongated hole 120*a*. As described above, when the full open latch 82 of the full open latch device OD is operated upon the closing operation of the door D, the open latch association mechanism 90 does not generate the release cancellation operation by the function of the elongated hole 92*a* of the cancellation lever 92. Therefore, in the present embodiment, the coupling pin 121 serves as a connection portion for the cable 504 for transmission of the release cancellation operation to the relay mechanism 117 side, and the coupling pin 121 is also configured to be moved in the elongated hole 120*a*, so that operation of the disconnection lever 120 upon operation of the full open latch 82 in the unlatching direction is further securely prevented. One end or the other end of the cable 504 is preferably movable, and one of the elongated holes 92*a* and 120*a* is preferably a circular hole portion for holding the coupling pins 95 and 121 immovable.

The disconnection lever 120 has a lower end formed with an arcuate elongated hole 120*b*. The floating pin 149 is slidably engaged with the elongated hole 120*b*.

The floating pin 149 is inserted through the control hole 118*a* of the relay lever 118, the elongated hole 119*a* of the transmission lever 119, and the elongated hole 120*b* of the disconnection lever 120 so as to be slidably moved.

When the disconnection lever 120 is at the connection position illustrated in FIG. 15, the floating pin 149 is positioned at the lower edge of the control hole 118*a* of the relay lever 118, and connects the release operation transmission path between the relay lever 118 and the transmission lever 119, and the release operation of the relay lever 118 can be transmitted to the transmission lever 119.

Figure 18:
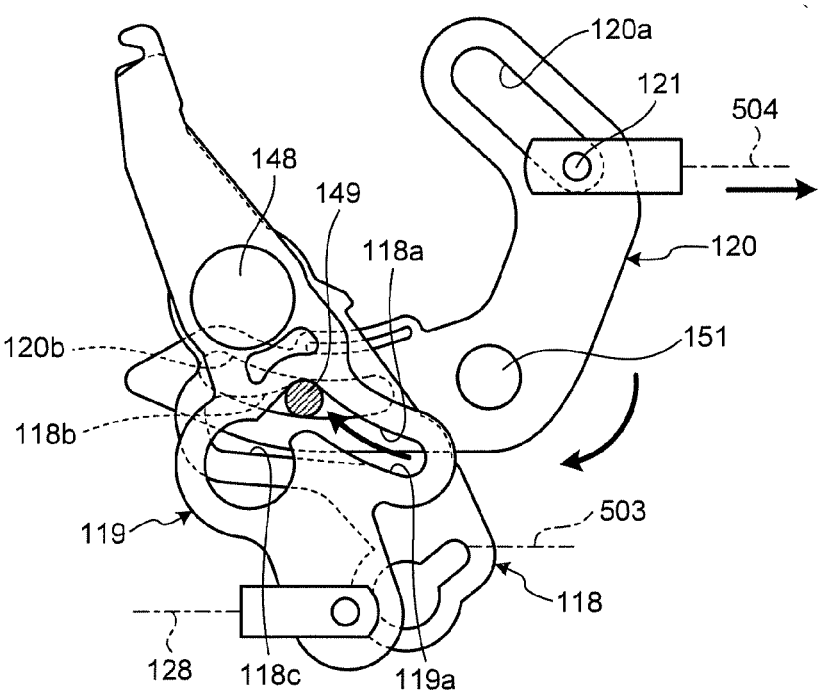
FIG. 18 is a schematic diagram illustrating the release cancellation input relay mechanism in a disconnection state upon release operation.
Figure 19:
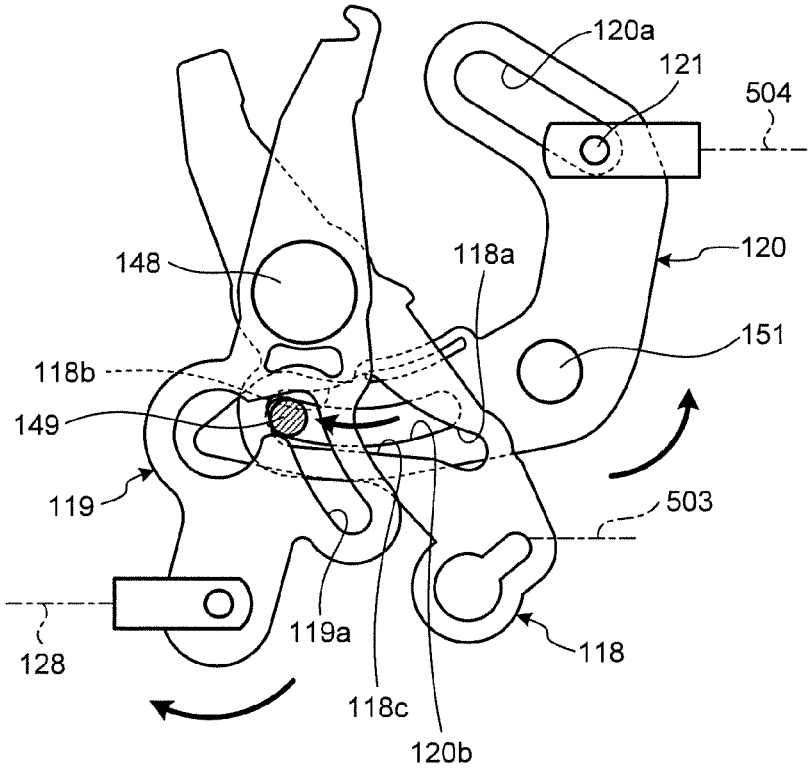
FIG. 19 is a schematic diagram illustrating a release cancellation operation of the open latch association mechanism transmitted to the release cancellation input relay mechanism.

As illustrated in FIG. 18, when the disconnection lever 120 is moved from the connection position to the disconnection position while the relay lever 118 and the transmission lever 119 are in the release operation state, the floating pin 149 is moved upward in the control hole 118*a*, along the elongated hole 119*a*. Therefore, as illustrated in FIG. 18, the floating pin 149 is moved to a position defined as a starting end of the non-operating portion 118*b* of the control hole 118*a* (the vertex of the L-shaped edge of the control hole 118*a*). While the floating pin 149 is positioned at this position, the floating pin 149 can be moved in the control hole 118*a*, along the non-operating portion 118*b*, and can be also moved in the elongated hole 120*b* of the disconnection lever 120, but cannot be moved in the elongated hole 119*a* of the transmission lever 119. Accordingly, a transmission state between the relay lever 118 and the transmission lever 119 is released, and the release operation transmission path is disconnected. Therefore, even when the relay lever 118 is in a release operation state as illustrated in FIG. 19, the transmission lever 119 and the lever mechanism 103 coupled to the transmission lever 119 by the coupling rod 128 can be returned to the standby position.

6. Description of Function of Opening-and-Closing Device for Vehicle Door

Next, the function of the opening-and-closing device for vehicle door DO according to the present embodiment will be described.

6.1 Release Operation by Handle Operation During Fully Closed State of Door

Upon opening operation of the outside handle OH or the inside handle IH while the door D is at the fully closed position and the operation relay device 100 is in the unlocked state, the opening operation is transmitted to the lever mechanism 103 of the operation relay device 100 (see FIG. 15). Accordingly, the release relay lever 116 performs the release operation through the lever group of the lever mechanism 103, and the release operation is transmitted to the rear door latch device 1 and the front door latch device FD through the cables 501 and 507.

In the rear door latch device 1, the release input lever 19 is operated to be released as illustrated in FIG. 7 from the standby position illustrated in FIG. 6. Therefore, the ratchet 9 is moved to the release position, an engagement state between the ratchet 9 and the latch 7 is released, and the close-latch mechanism LC is operated to be released. At the same time, the front door latch device FD is also operated to be released, and the door D can be opened.

6.2 Release Operation by Handle Operation During Fully Opened State of Door

Upon the closing operation of the inside handle IH while the door D is at the fully opened position and the operation relay device 100 is in the unlocked state, the closing operation is transmitted to the lever mechanism 103 of the operation relay device 100 (see FIG. 15). Accordingly, the closing inside lever 111 performs the release operation through the lever group of the lever mechanism 103, the release operation is transmitted to the full open latch device OD through the cable 506.

In the full open latch device OD, the release input lever 86 is operated to be released as illustrated in FIG. 12, from a latched position illustrated in FIG. 11. Therefore, the ratchet 83 is moved to the release position, and the engagement state between the ratchet 83 and the full open latch 82 is released, the open-latch mechanism LO is operated to be released, and the door D can be closed.

6.3 Release Operation by Electric-Powered Releasing Mechanism

Upon opening operation of the operation switch provided in the vehicle or the wireless operation switch while the door D is at the fully closed position and the close-latch mechanism LC is in the fully latched state, the motor 32 constituting the electric-powered releasing mechanism R is driven to be released. Accordingly, the sector gear 39 is turned in the release direction (counterclockwise direction) as illustrated in FIG. 7 from a state illustrated in FIG. 6, the sun gear 35 is turned by a predetermined angle in the release direction from the neutral position in association with counterclockwise rotation of the planetary gear 36.

As illustrated in FIG. 7, the abutment portion 35*b* of the sun gear 35 turned in the release direction presses the release portion 41*a* of the release output lever 41. Therefore, the release output lever 41 is operated to be released from the standby position against an urging force of the spring 46. The release operation is transmitted to the relay lever 118 of the relay mechanism 117 in the connection state through the cable 503.

Figure 17:
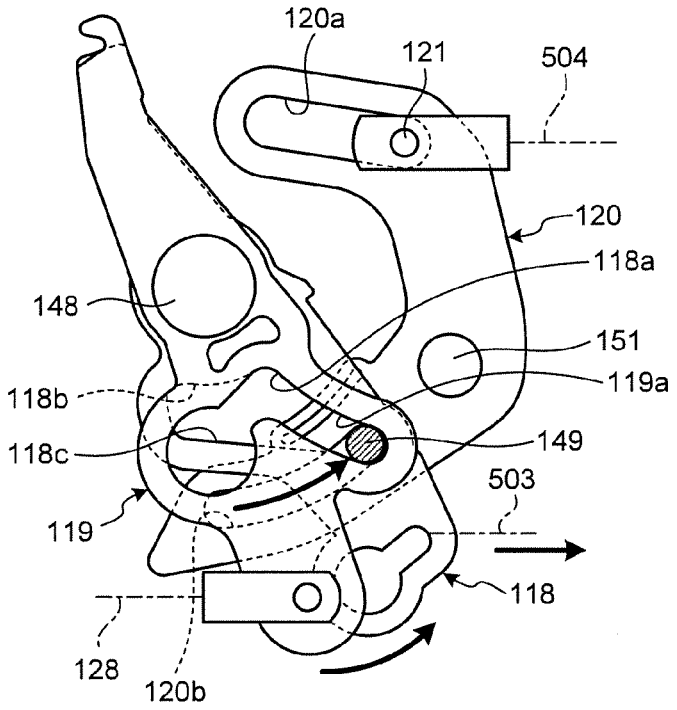
FIG. 17 is a schematic diagram illustrating a release operation of the release cancellation input relay mechanism in a connection state.

As illustrated in FIG. 17, when the release operation of the release output lever 41 is transmitted, the relay lever 118 is operated to be released from the standby position illustrated in FIG. 15. When the relay lever 118 is operated to be released, the transmission lever 119 is also operated to be released under engagement of the floating pin 149. The release operation is transmitted to the lever mechanism 103 of the operation relay device 100 through the coupling rod 128, and the release relay lever 116 is operated to be released.

The release operation of the release relay lever 116 is transmitted to the rear door latch device 1 and the front door latch device FD through the cables 501 and 507. In the rear door latch device 1, the release input lever 19 is operated to be released as illustrated in FIG. 7 from the standby position illustrated in FIG. 6. Therefore, the ratchet 9 is moved to the release position, the engagement state between the ratchet 9 and the latch 7 is released, and the close-latch mechanism LC can be removed from the striker S1. At the same time, the front door latch device FD is also operated to be released, and the door D can be opened.

As illustrated in FIG. 3, the sector gear 39 and the sun gear 35 are reversely rotated to be returned to the neutral positions, and the release output lever 41 in the release operation is returned to the standby position. Therefore, the electric-powered releasing mechanism R is returned to a standby state from the release operation state, and the other elements in the release operation are also returned to their standby positions, respectively.

6.4 Release Cancellation Operation Upon Cancellation of Release Restrained State When the door D is operated to be opened from the fully closed position, the release operation of the release output lever 41 by the release drive of the motor 32 without operational malfunction returns the various elements to their neutral positions or standby positions by reverse drive of the motor 32. Therefore, upon the subsequent closing operation of the door D, the ratchet 9 can be engaged with the full-latch engagement portion 7*a* or the half-latch engagement portion 7*b* of the latch 7.

However, as illustrated in FIG. 7, when the operational malfunction occurs while the ratchet 9 is moved to the release position by the release drive of the motor 32, there is a possibility that the motor 32 may not be reversed. In such a case, the release restrained state occurs in which the release output lever 41 is stopped in the release operation state, the ratchet 9 is stopped at the release position and cannot be returned to the engagement position with the latch 7. When the release restrained state occurs, the ratchet 9 is stopped at the release position and cannot be moved to the engagement position at which the ratchet 9 is engaged with the latch 7, so that the door D cannot be held at a closed position. It is noted that such operational malfunction is detected based on, for example, continuation of the detection signal from the detection switch for detecting the release position of the ratchet 9, for a time equal to or more than a certain time, or non-detection at the detection switch 48 for detecting the neutral position of the sector gear 39.

Then, the opening-and-closing device for vehicle door DO according to the present embodiment includes the relay mechanism 117 and the open latch association mechanism 90. Therefore, even when the release restrained state occurs while the door D is operated to be opened, the release restrained state can be canceled, and the door D can be held at the closed position.

Specifically, the release operation is performed as described above, and even when the rear door latch device 1 and the relay mechanism 117 are stopped at positions illustrated in FIGS. 7 and 17, respectively, or even when the release restrained state occurs, the door D can be operated to be opened up to the fully opened position. Therefore, the open-latch mechanism LO of the full open latch device OD is brought into a latched state at a timing immediately before the door D is positioned at the fully opened position, and the release cancellation operation of the open latch association mechanism 90 is brought about at that time.

The release cancellation operation of the open latch association mechanism 90 is transmitted through the cable 504 to the disconnection lever 120 of the relay mechanism 117 in the connection state illustrated in FIG. 17, from the cancellation lever 92 turned in the cancellation direction.

The disconnection lever 120 receiving the transmission of the release cancellation operation is moved to the disconnection position from the connection position, as illustrated in FIG. 18. At this time, the floating pin 149 is pressed and driven by the elongated hole 120*a* of the disconnection lever 120 moved to a disconnection position. That is, the floating pin 149 is moved upward along the control hole 118*a* of the relay lever 118 and the elongated hole 119*a* of the transmission lever 119, and moved to the position defined as the starting end of the non-operating portion 118*b* of the control hole 118*a* (see FIG. 18). In this state, the floating pin 149 is pressed by the elongated hole 119*a* when the transmission lever 119 is moved to the standby position, is movable in the control hole 118*a* along the non-operating portion 118*b*, and also movable in the elongated hole 120*b*. Therefore, a transmission path between the relay lever 118 and the transmission lever 119, or the release operation transmission path for transmitting the release operation of the electric-powered releasing mechanism R to the ratchet 9 is disconnected. As a result, when the release output lever 41 is stopped in the release operation state even at this moment, the transmission lever 119 is returned to the standby position by the urging force of the spring 150 while the relay lever 118 remains in the release operation state, as illustrated in FIG. 19. It is noted that, in a normal state in which the operational malfunction does not occur, the floating pin 149 is returned to a position illustrated in FIG. 17 from a position illustrated in FIG. 18, according to the operation of the disconnection lever 120.

Figure 8:
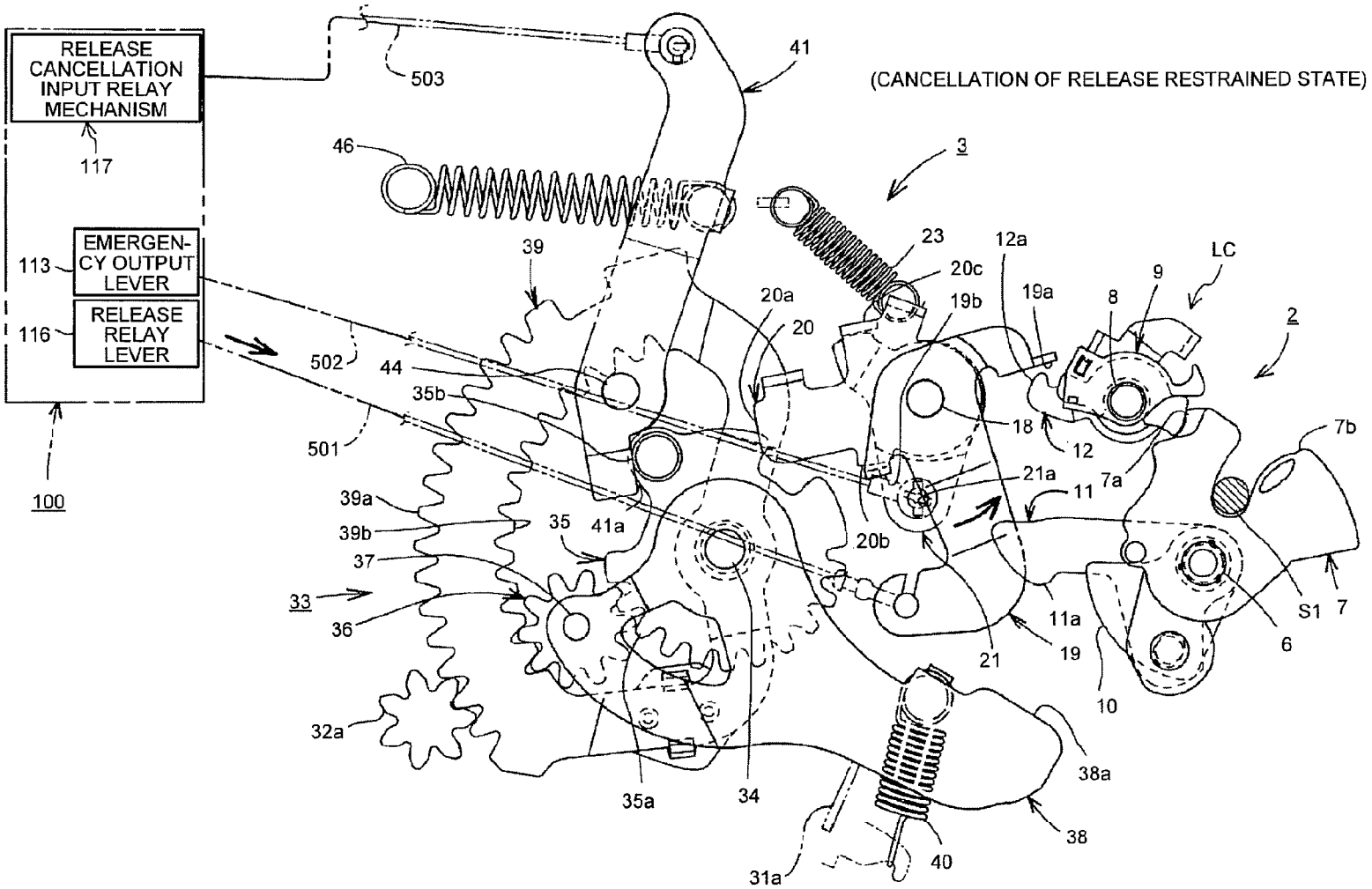
FIG. 8 is a schematic diagram illustrating cancellation of a release restrained state of the rear door latch device.

As illustrated in FIG. 19, when the transmission lever 119 is returned to the standby position, the coupling rod 128 is returned to a standby position following the returning of the transmission lever 119. Then, the release relay lever 116 constituting the lever mechanism 103 of the operation relay device 100 is returned to a standby position, and the release input lever 19 is also returned to a standby position following the returning of the release relay lever 116, as illustrated in FIG. 8. As a result, as illustrated in FIG. 8, the ratchet 9 can be returned while the release output lever 41 is restrained in the release operation state. Accordingly, when the door D is operated to be closed from the fully opened position, the latch 7 is meshed with the striker S1, the ratchet 9 is engaged with the latch 7, and the door D is held at the closed position.

Then, when the failure or the like causing the release restrained state is resolved, and the release output lever 41 is returned to the standby position from the release operation state, the relay lever 118 is returned to the standby position from the release position illustrated in FIG. 19 following movement of the release output lever 41 to the standby position. Accordingly, the control hole 118*a* of the relay lever 118 and the elongated hole 119*a* of the transmission lever 119 are returned to a positional relationship illustrated in FIG. 15. Therefore, the floating pin 149 positioned at the terminal end of the non-operating portion 118*b* of the control hole 118*a* is returned to a position illustrated in FIG. 15 while making slide contact with the inclined portion 118*c* of the control hole 118*a*, in association with returning of the disconnection lever 120 to the connection position by the urging force of the spring 152. As a result, the relay mechanism 117 is in the connection state again as illustrated in FIG. 15. It is noted that, when the operational malfunction occurs, the door D does not respond to automatic opening of the door D from the fully closed state by the electric open/close unit PSD, and automatic closing of the door D from the fully opened state. Therefore, the user can readily recognize occurrence of the failure or the like, and the door D can be held at the closed position by the function of the relay mechanism 117 and the open latch association mechanism 90, until repaired.

Now, when the release restrained state is canceled by the opening operation of the door D, as described above, returning sound is generated by the ratchet 83 of the full open latch device OD, the transmission lever 119 of the relay mechanism 117, the lever mechanism 103 of the operation relay device 100, and the lever group of the closer/release unit 3. Meanwhile, in the operation of the full open latch 82 during closing operation of the door D, the release cancellation operation is not generated by the function of the elongated hole 92*a* of the cancellation lever 92 and the elongated hole 120*a* of the disconnection lever 120, as described above, so that the returning sound is not generated, and the user does not feel discomfort or uncomfortable feeling.

Further, when the operational malfunction of the motor 32 is detected while the door D is operated to be closed in the closing direction from the fully opened position by the electric open/close unit PSD, the electric open/close unit PSD is reversely controlled by the control unit C to operate the door D to be opened toward the fully opened position. Therefore, the cancellation lever 92 of the open latch association mechanism 90 is operated in the cancellation direction, the relay mechanism 117 is switched to the disconnection state, and the release restrained state can be canceled. Accordingly, even when the release restrained state occurs during the closing operation of the door D, the release restrained state can be reliably canceled, and then, the door D can be manually closed to hold the door D at the closed position.

As described above, the opening-and-closing device for vehicle door DO according to the present embodiment can cancel the release restrained state by normal operation of only opening the door D. Therefore, even when the release restrained state occurs, the user does not need to perform special operation, and the door D can be held at the closed position.

According to an embodiment of the present invention, the release restrained state can be canceled by normal operation of only opening a door. Further, when operational malfunction of an electric-powered releasing mechanism is detected by the control unit while the door is operated to be closed from a fully opened position, the electric open/close unit is reversely controlled to open the door, and the release restrained state is canceled. Therefore, even when the release restrained state occurs, the user does not need to perform special operation, and the door can be held at the closed position.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An opening-and-closing device for vehicle door, the opening-and-closing device comprising:

a close-latch mechanism that is provided to a door, the close-latch mechanism including a first latch configured to move from a first unlatched position to a first latched position and a first ratchet subject to an urging force and configured to engage with the first latch in the first latched position to hold the door in a closed position;

an open-latch mechanism that is provided to the door, the open-latch mechanism including a second latch configured to move from a second unlatched position to a second latched position and a second ratchet configured to engage with the second latch in the second latched position to hold the door in an opened position;

an electric-powered releasing mechanism that is configured to operate the first ratchet to a release position;

an association mechanism that is configured to operate in a cancellation direction from an initial position in association with movement of the second latch from the second unlatched position to the second latched position indicative of a fully opened position of the door;

a relay mechanism that is configured to switch from a connection state to a disconnection state to allow the first ratchet to turn from the release position to a first engagement position by the urging force, the connection state connecting a release operation transmission path configured to transmit release operation of the electric-powered releasing mechanism to the first ratchet, the disconnection state disconnecting the release operation transmission path, the connection state switching to the disconnection state by operation of the association mechanism in the cancellation direction;

and a control unit that is configured to cause the door to move toward the fully opened position, operate the association mechanism in the cancellation direction, and switch the relay mechanism to the disconnection state, based upon a detection signal, transmitted from a detection switch, indicative of operational malfunction of the electric-powered releasing mechanism during closing of the door from the fully opened position to a fully closed position.

* * * * *